US006524145B1

(12) United States Patent
Arzate

(10) Patent No.: US 6,524,145 B1
(45) Date of Patent: Feb. 25, 2003

(54) SWIMMER PROPULSION DEVICE

(76) Inventor: Jesse Gallegos Arzate, 11208 E. St., Corpus Christi, TX (US) 78418

( * ) Notice: Subject to any disclaimer, the term of this patent is extended or adjusted under 35 U.S.C. 154(b) by 0 days.

(21) Appl. No.: 09/904,461

(22) Filed: Jul. 12, 2001

(51) Int. Cl.[7] ..... B63H 1/36
(52) U.S. Cl. ..... 440/15; 114/315; 440/26
(58) Field of Search ..... 114/315; 440/13, 440/14, 15, 21, 26

(56) References Cited

U.S. PATENT DOCUMENTS

| | | | | |
|---|---|---|---|---|
| 227,491 A | | 5/1880 | Coultee | |
| 619,714 A | | 2/1899 | Birkby | |
| 685,437 A | | 10/1901 | Sheen | |
| 943,074 A | | 12/1909 | Hildebrandt | |
| 1,160,722 A | | 11/1915 | Lackner | |
| 2,592,498 A | | 4/1952 | Wells | |
| 2,696,797 A | * | 12/1954 | Whidden | 440/14 |
| 2,854,787 A | * | 10/1958 | Oberg | 440/15 |
| 3,204,699 A | | 9/1965 | Gongwer | |
| 3,440,994 A | | 4/1969 | McGowan | |
| 4,193,371 A | | 3/1980 | Baulard-Caugan | |
| 4,345,903 A | * | 8/1982 | Laser | 440/14 |
| 4,642,056 A | | 2/1987 | Keivanjah | |
| 6,033,276 A | * | 3/2000 | Han | 441/135 |

FOREIGN PATENT DOCUMENTS

| | | | | |
|---|---|---|---|---|
| FR | 2 616 076 | * | 12/1988 | 440/15 |
| SU | 1509095 A1 | * | 9/1989 | 440/15 |

OTHER PUBLICATIONS

Website product literature for TUSA swimming fins available May 2001.

* cited by examiner

*Primary Examiner*—Sherman Basinger
(74) *Attorney, Agent, or Firm*—George S. Gray

(57) ABSTRACT

A swimmer propulsion device includes a harness with attached frame and resilient tail assembly. A foot-operated driver on the frame rotates and forces an apex member against the fluked tail assembly, while tensioning propulsion bands. As the apex member rotates beyond perpendicular, the band snaps the upwardly displaced tail assembly downwardly, thus thrusting the swimmer forward. The tail assembly has a spine with resilient vertebrae and a resilient portion that are all deformed as the tail assembly is displaced upwardly by the apex member. As the tail assembly moves downwardly, the resilient portion and the vertebrae return to the undeformed state, thus adding thrust to that provided by the bands. Interchangeable drivers and propulsion bands are provided that adjusts the amount of thrust provided by the system. Interchangeable flukes and dorsal fins are also provided. A single piece tail assembly is also provided as an alternate.

43 Claims, 28 Drawing Sheets

SWIMMER PROPULSION DEVICE

BACKGROUND OF THE INVENTION

1. Field of the Invention

The present invention relates generally to devices for propelling a swimmer through water using body strength.

2. Description of the Prior Art

There have been propulsion devices available for several years that have several common features in that fin-like members are used to propel the device.

Keivanjah (U.S. Pat. No. 4,642,056) provides a water craft in which the operator is seated. Fins on an H-shaped frame are cam actuated to propel the craft.

Hildebrandt (U.S. Pat. No. 943,074) discloses a boat propeller that includes a cam mounted on a rotary shaft that causes a vertically positioned caudal fin to move from side to side.

Gongwer (U.S. Pat. No. 3,204,699) includes a swimmer propulsion device that attaches to the swimmers lower legs. A leg plate is straddled by the swimmer, from which a curved rod extends forwardly. A pair of oscillating fins is pivotally attached to the curved rod, the fins being positioned beneath the swimmer's lower torso, when the swimmer is horizontal.

Baulard-Caugan (U.S. Pat. No. 4,193,371) provides a swimmer propulsion device with a vertically oriented fish tail member on two arms that are in turn mounted on two additional arms, to which are attached foot stirrups. Pushing one of the stirrups causes the arm linkage to push the tail in one direction, and pushing the other stirrup causes the arm linkage to push the tail in the other direction.

McGowan (U.S. Pat. No. 3,440,994) includes a swimmer propulsion device having a vertically positioned tail fin that is pushed left and right by using alternate feet to push on opposite ends of a pivot bar that is rigidly attached to the tail fin.

Coulter (U.S. Pat. No. 227,491) discloses a sculling-propeller for boats that provides hand operated controls for moving a rear-mounted fin-like blade.

Only some of the foregoing are for swimmers, and of those that are for swimmers, the devices require large structures with a large number of parts in relatively complicated arrangements. None provides a swimming device that has a high-degree of integration with the contours of the swimmer's body, nor do any provide an unobtrusive, yet effective means of oscillating horizontally positioned flukes. Furthermore, no prior art devices allow the swimmer's feet to simultaneously contribute to the means for moving the flukes.

SUMMARY OF THE PRESENT INVENTION

The present invention is a swimmer propulsion device that is streamlined in shape for integration with the contours of the swimmer's body, the device including an unobtrusive and effective means of oscillating horizontally positioned flukes, using the combined force of both the swimmer's feet.

The device includes a harness for the swimmer that has a flexible tail assembly and a frame with ratcheting pedals that simultaneously rotate a driver. This rotation causes one of three driver apexes to be forced against, and to displace, the tail assembly while simultaneously tensioning a propulsion band. The propulsion band snaps the tail assembly downward when the driver apex continues to move such that it is no longer displacing the tail assembly. This downward movement of the tail assembly and its flukes propels the swimmer forward.

A flexible spine is included in the tail assembly, with the individual vertebra in the spine being resilient, such that the displacement of the tail assembly by the driver apex deforms the vertebrae. Upon release the vertebrae return to the undeformed shape, thus adding to the downward force on the tail assembly.

A swimmer propulsion device is provided, comprising: a harness to be affixed to the body of the swimmer; a frame extending from the harness toward the feet of the swimmer; a tail assembly having: a flexible spine; and a tail member; a foot-powered driving assembly having: at least one foot pedal to be attached to the swimmer's foot, the at least one foot pedal having a forward position and a rearward position; and a driver rotatably attached to the frame and ratchetably rotated by a rearward push on the at least one foot pedal, the driver having at least three apex members, the driver being spaced from the tail assembly such that two of the apex members are proximate the tail assembly; and at least one resilient propulsion member attached to the tail assembly and the frame, such that, as the at least one foot pedal is being pushed rearwardly, the driver is rotated causing one of the apex members to singularly bear upon the tail assembly, the single apex member displacing the tail assembly such that the tail member moves from a first position to a second position, the displacement of the tail assembly placing the at least one propulsion member in tension, the continued rotation of the driver causing the single apex member to rotate beyond the perpendicular position against the tail assembly, the propulsion member tension then causing the at least one propulsion member to contract and pull the tail assembly such that the tail member is brought from the second position to the first position, the at least one foot pedal being ratchetably movable to the forward position.

In one embodiment, each apex member has a roller, the roller being the portion of the apex member that bears upon the tail assembly.

In one embodiment, the tail assembly has a generally longitudinal groove, the groove receiving and laterally constraining the single apex member as the single apex member bears upon the tail assembly.

In one embodiment, the number of pedals is two and the number of propulsion members is two, the pedals being attached for simultaneous movement from the forward to the rearward position.

In one embodiment, the number of pedals is two, each pedal being independently ratchetable and pushable, such that the driver is rotated by pushing either of the pedals.

In one embodiment, the number of pedals is one, the pedal being adapted for simultaneous pushing by both swimmer feet.

In one embodiment, the spine further comprises a first vertebra and a plurality of vertebrae, each of the vertebrae plurality being successively and partially encompassed by another of the vertebrae, and a resilient cord extending through the vertebrae such that the vertebrae are aligned and secured, the vertebrae being resilient such that, as the tail assembly is displaced by the single apex member, the vertebrae are deformed, and as the single apex member rotates beyond the perpendicular position against the tail assembly, the vertebrae return to the undeformed state, thus causing a displacement of the tail assembly such that the tail member is moved toward the second position.

In one embodiment, the vertebrae having decreasing widths in a direction horizontally perpendicular to the longitudinal axis of the tail assembly.

In one embodiment, the vertebrae having decreasing heights in a direction vertically perpendicular to the longitudinal axis of the tail assembly.

In one embodiment, the harness has at least one dorsal fin.

In one embodiment, the at least one dorsal fin is detachable.

In one embodiment, the tail assembly has at least one dorsal fin.

In one embodiment, the at least one dorsal fin is detachable.

In one embodiment, the tail member has at least one dorsal fin.

In one embodiment, the at least one dorsal fin is detachable.

In one embodiment, the tail member is flexible.

In one embodiment, the tail member has two flukes.

In one embodiment, the tail member flukes have at least one thickened edge.

In one embodiment, the tail member flukes have at least one reinforced edge.

In one embodiment, the harness further comprises a first back member and a second back member, the second back member being coupled to the first back member, the frame being attached to the harness second back member.

In one embodiment, the second back member is slidably coupled to the first back member.

In one embodiment, the harness further comprises a first back member and a second back member, the second back member being coupled to the first back member, the tail assembly being attached to the harness second back member.

In one embodiment, the second back member is slidably coupled to the first back member.

In one embodiment, the tail member further comprises lateral stabilizers.

In one embodiment, the tail member further comprises at least one thickened outer edge.

In one embodiment, the tail member further comprises at least one reinforced outer edge.

In one embodiment, the device further comprises a second driver to be interchanged with the driver, the second driver having longer apexes than the driver.

In one embodiment, the device further comprises a second driver to be interchanged with the driver, the second driver having shorter apexes than the driver.

In one embodiment, the device further comprises a second driver, interchangeable with the driver, the second driver having more apexes than the driver.

In one embodiment, the device further comprises a second driver, interchangeable with the driver, the second driver having less apexes than the driver, but at least three apexes.

In one embodiment, the tail assembly further comprises a resilient portion, the driver single apex bearing upon such resilient portion during rotation such that the portion is deformed as the single apex member rotates, and returns to the undeformed state when the single apex member rotates beyond the perpendicular position against the portion, thus causing a displacement of the tail assembly such that the tail member is moved toward the second position.

In one embodiment, the resilient portion has a generally longitudinal groove, the groove receiving and laterally constraining the single apex member as the single apex member bears upon the resilient portion.

In one embodiment, the device further comprises a second propulsion member, interchangeable with the at least one propulsion member, the second propulsion member requiring a different amount of force for tensioning.

In one embodiment, the tail member further comprises a central stabilizer.

In one embodiment, the tail member further comprises a tail member top and a substantially rigid member positioned proximate the tail member top, such that as the tail member is forced back to the first position, the tail member top is forced against the rigid member, the rigid member then at least partially impeding the further deformation of the tail member.

In one embodiment, the tail member is removably attached.

In one embodiment, the device further comprises a second tail member, interchangeable with the tail member.

There is provided a swimmer propulsion device, comprising: a harness to be affixed to the body of the swimmer; a frame extending from the harness toward the feet of the swimmer; a tail assembly having: a flexible spine; and a tail member; means for moving the tail member from a first position to a second position using footpower; and means for forcing the tail member from the second position to the first position.

In one embodiment, the tail member further comprises means for lateral stabilization.

In one embodiment, the tail member further comprises means for central stabilization.

In one embodiment, the means for forcing the tail member from the second position to the first position further comprises means for varying the rate at which the tail member is forced back to the first position.

In one embodiment, the means for moving the tail member from the first position to the second position further comprises means for varying the distance between said positions.

A swimmer propulsion device is provided, comprising: a harness to be affixed to the body of the swimmer, the harness further comprising a first back member and a second back member, the second back member being slidably coupled to the first back member; a frame extending from the harness second back member toward the feet of the swimmer; a tail assembly extending from the harness second back member having: a flexible spine, the spine further comprising a first vertebra and a plurality of vertebrae, each of the vertebrae plurality being successively and partially encompassed by another of the vertebrae, and a resilient cord extending through the vertebrae such that the vertebrae are aligned and secured; a resilient portion, having a generally longitudinal groove; and a tail member; a foot-powered driving assembly having: a pair of foot pedals to be attached to the swimmer's feet, the pedals having a forward position and a rearward position; and a driver rotatably attached to the frame and ratchetably rotated by a rearward push on the foot pedals, the driver having three apex members, each apex member having a roller, the driver being spaced from the tail assembly such that two of the apex member rollers are proximate the tail assembly resilient portion longitudinal groove; and a pair of resilient propulsion members attached to the tail assembly and the frame, such that, as the foot pedals are being pushed rearwardly, the driver is rotated causing one of the apex member rollers to singularly bear upon the resilient portion longitudinal groove, the single apex member roller displacing the tail assembly such that the tail member moves from a first position to a second position, the displacement of the tail assembly placing the propulsion members in tension, the continued rotation of the driver causing the single apex member roller to rotate beyond the perpendicular position against the tail assembly, the propulsion member tension then causing the propulsion members to contract and pull the tail assembly such that the tail member is brought from the second position to the first position, the foot pedals being ratchetably movable to the forward position.

The foregoing and other advantages will appear from the description to follow. In the description reference is made to the accompanying drawings, which form a part hereof, and in which is shown by way of illustration, specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

DESCRIPTION OF THE REFERENCED NUMERALS

Figure 1:
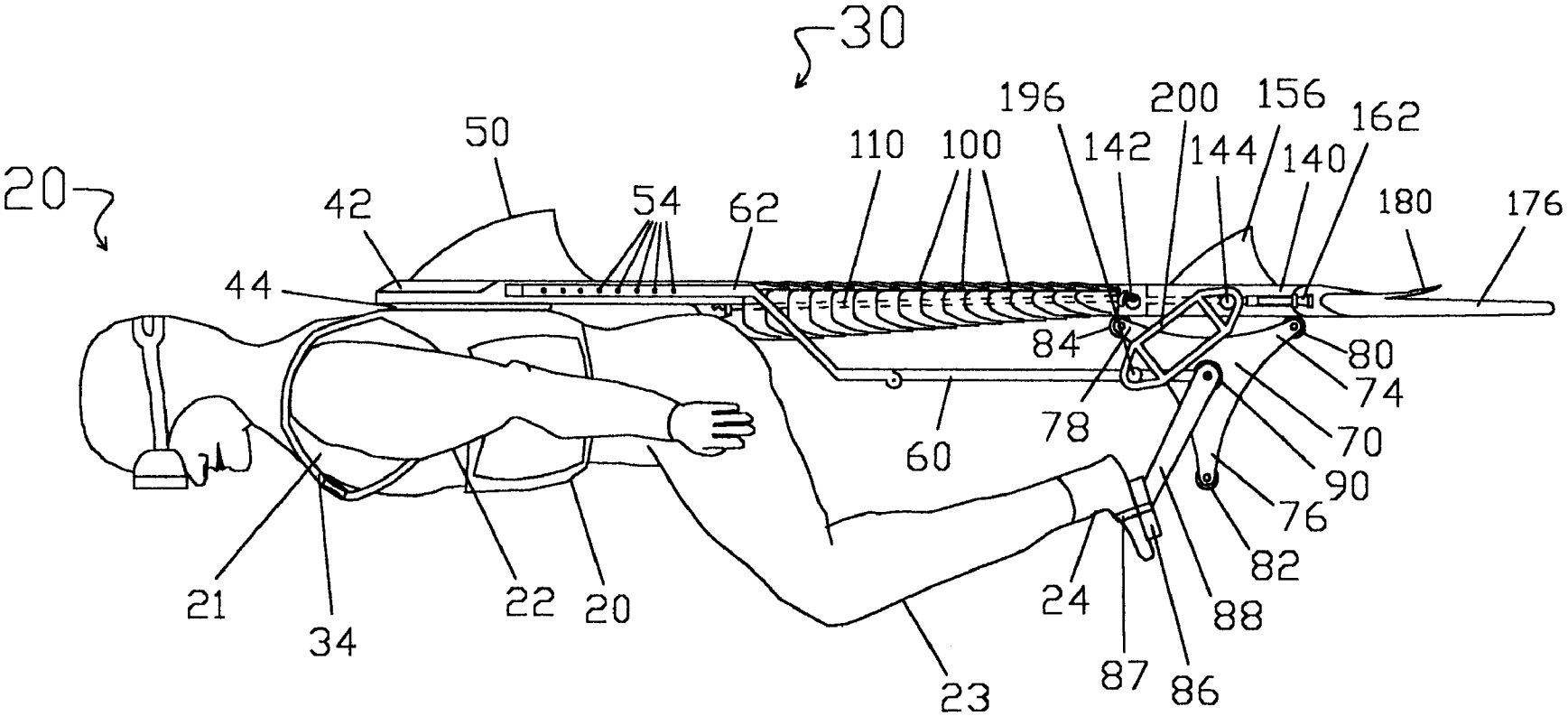
FIG. 1 is a side view of the device in use, where the swimmer has ratcheted the pedals forward in preparation for a rearward push.

Turning now descriptively to the drawings, in which similar reference characters denote similar elements throughout the several views, the figures illustrate the swimmer propulsion device of the present invention. With regard to the reference numerals used, the following numbering is used throughout the various drawing figures.

| | |
|---|---|
| 20 | swimmer |
| 21 | swimmer torso |
| 22 | swimmer arms |
| 23 | swimmer legs |
| 24 | swimmer feet |
| 30 | swimmer propulsion device of the present invention |
| 32 | vest |
| 34 | vest shoulder strap |
| 36 | vest shoulder strap latch members |
| 38 | vest torso belt |
| 40 | torso belt latch members |
| 42 | backplate |
| 44 | backplate attachment member |
| 46 | backplate attachment member runner slots |
| 48 | backplate runners |
| 50 | backplate dorsal fin |
| 52 | backplate side holes |
| 54 | fasteners |
| 60 | frame |
| 62 | frame front members |
| 64 | frame rear members |
| 70 | driver |
| 72 | axle |
| 74 | first apex member |
| 76 | second apex member |
| 78 | third apex member |
| 80 | first apex member roller |
| 82 | second apex member roller |
| 84 | third apex member roller |
| 86 | foot pedal |
| 87 | pedal straps |
| 88 | foot pedal arms |
| 90 | ratchet gear |
| 100 | vertebra |
| 102 | vertebra forward portion |
| 104 | vertebra upper extensions |
| 106 | vertebra lower extensions |
| 108 | vertebra hole |
| 110 | cord |
| 112 | cord front loop |
| 114 | cord rear loop |
| 120 | backplate upper extensions |
| 122 | backplate lower extensions |
| 124 | backplate hole |
| 126 | backplate slot |
| 130 | hook member |
| 132 | hook member bar |
| 134 | hook member loop |
| 140 | thruster |
| 142 | thruster forward extensions |
| 144 | thruster rearward extensions |
| 146 | thruster slots |
| 147 | thruster groove |
| 148 | thruster front portion |
| 150 | thruster rear portion |
| 152 | thruster hole |
| 154 | thruster rear slot |

-continued

| | |
|---|---|
| 156 | thruster dorsal fin |
| 158 | bar |
| 160 | pin |
| 162 | pin latches |
| 164 | pin hole |
| 166 | fluke assembly |
| 168 | flukefront portion |
| 170 | fluke pin hole |
| 172 | thruster rear upper extensions |
| 174 | thruster rear lower extensions |
| 176 | flukes |
| 178 | fluke thickened edges |
| 180 | fluke central stabilizer |
| 182 | orca whale fluke shape |
| 184 | alternate fluke shape |
| 186 | alternate fluke shape |
| 188 | alternate fluke shape |
| 190 | alternate fluke shape |
| 192 | alternate fluke shape |
| 193 | alternate fluke shape |
| 194 | alternate fluke shape |
| 195 | alternate fluke shape |
| 196 | frame extensions |
| 200 | propulsion band |
| 230 | resilient member |
| 250 | alternate vertebrae |
| 252 | alternate driver |

DETAILED DESCRIPTION OF PREFERRED EMBODIMENTS

Referring now to the drawings in more detail, in which similar reference characters denote similar elements throughout the several views, FIGS. 1–25 and illustrate the swimmer propulsion device of the present invention indicated generally by the numeral 30.

Figure 2:
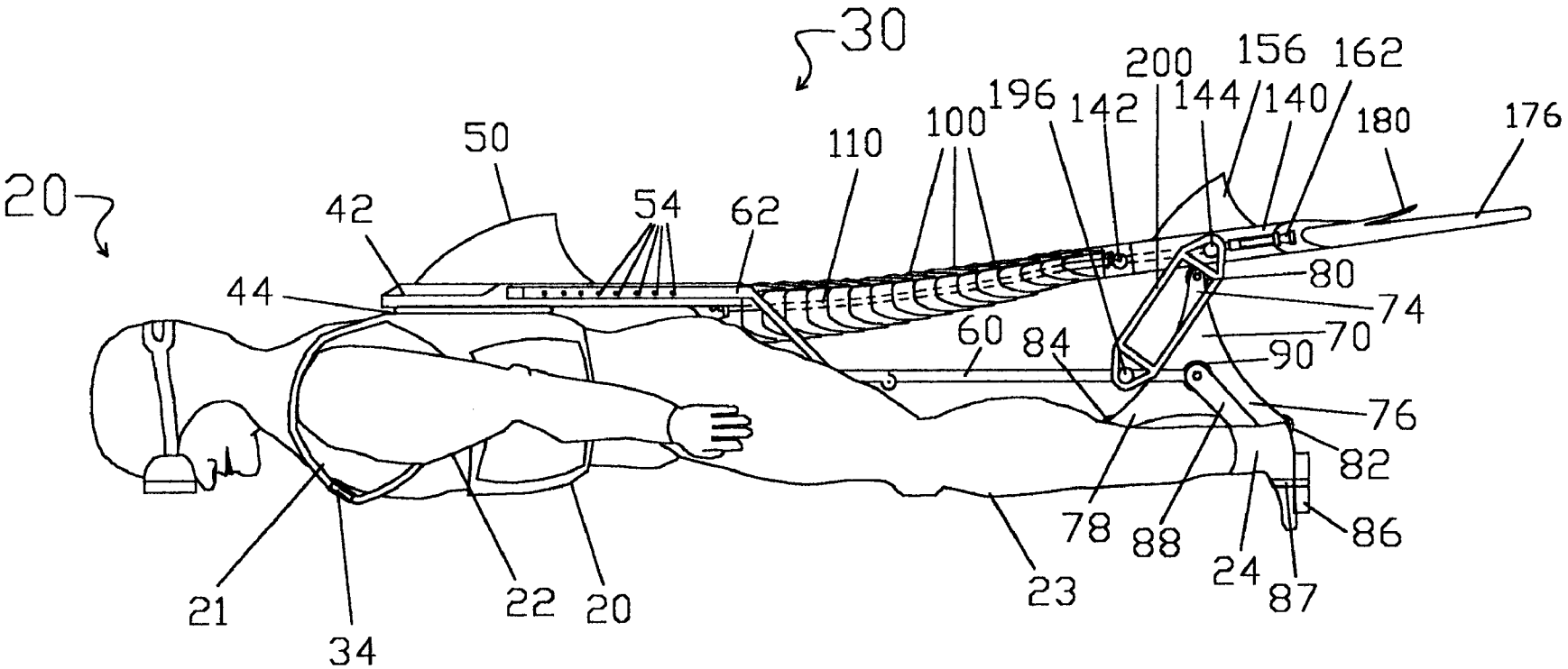
FIG. 2 is a side view of the device in use, where the swimmer has pushed rearwardly to the point where the driver has tensioned the propulsion band as the driver apex is forced against the tail assembly.
Figure 3:
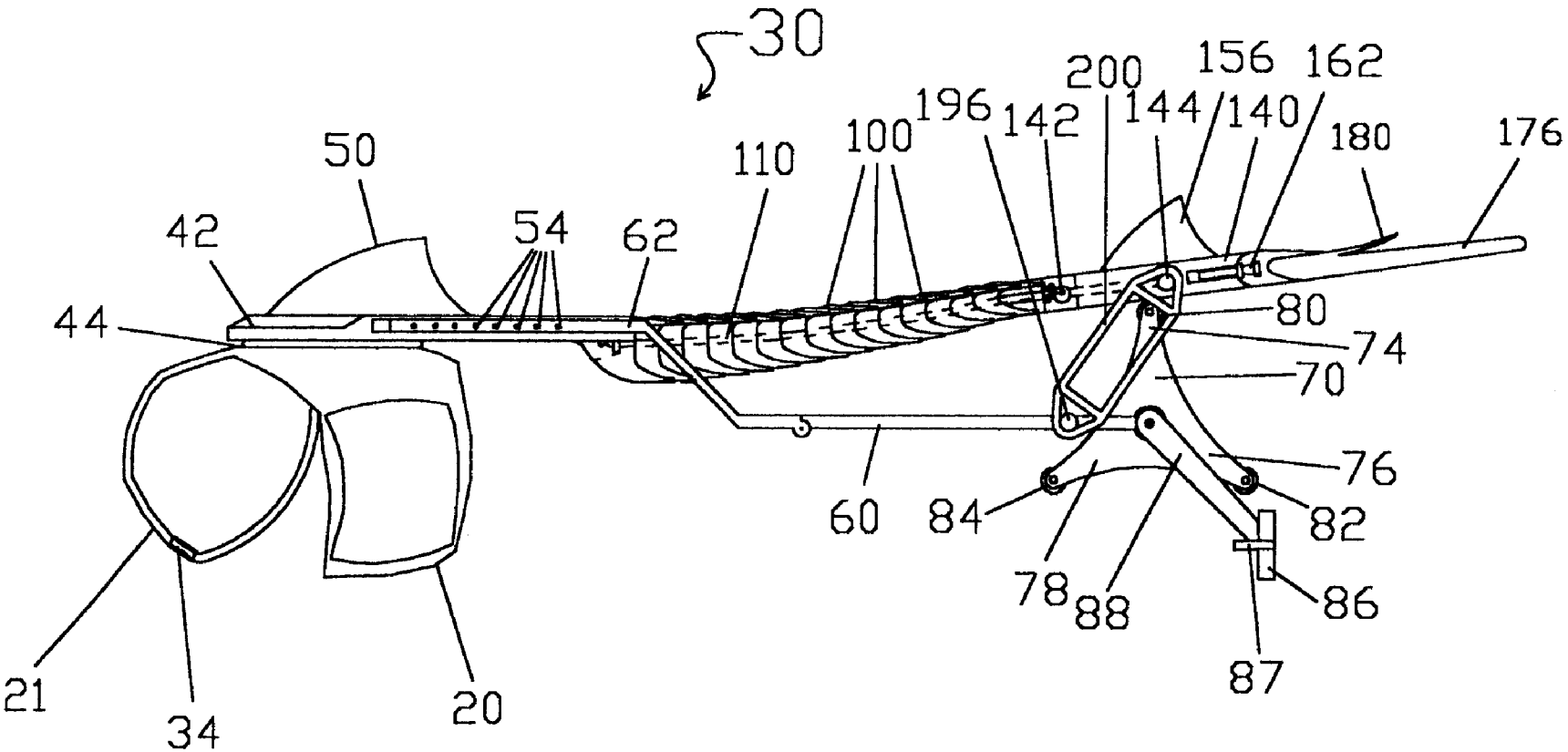
FIG. 3 is a side view of the device, without the swimmer, with driver in the same position as in FIG. 2.
Figure 4:
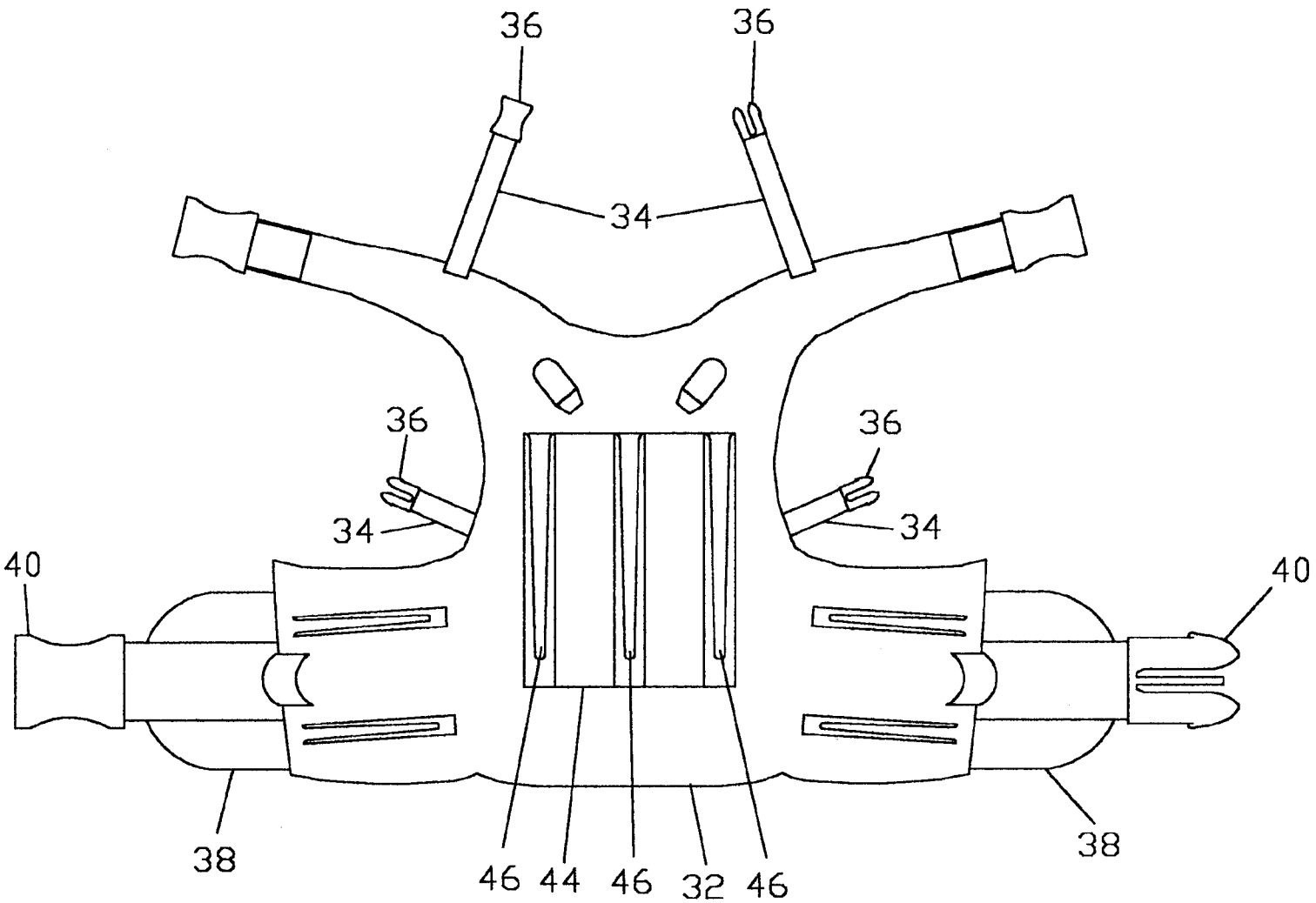
FIG. 4 is a top view of the harness with the backplate removed.
Figure 5:
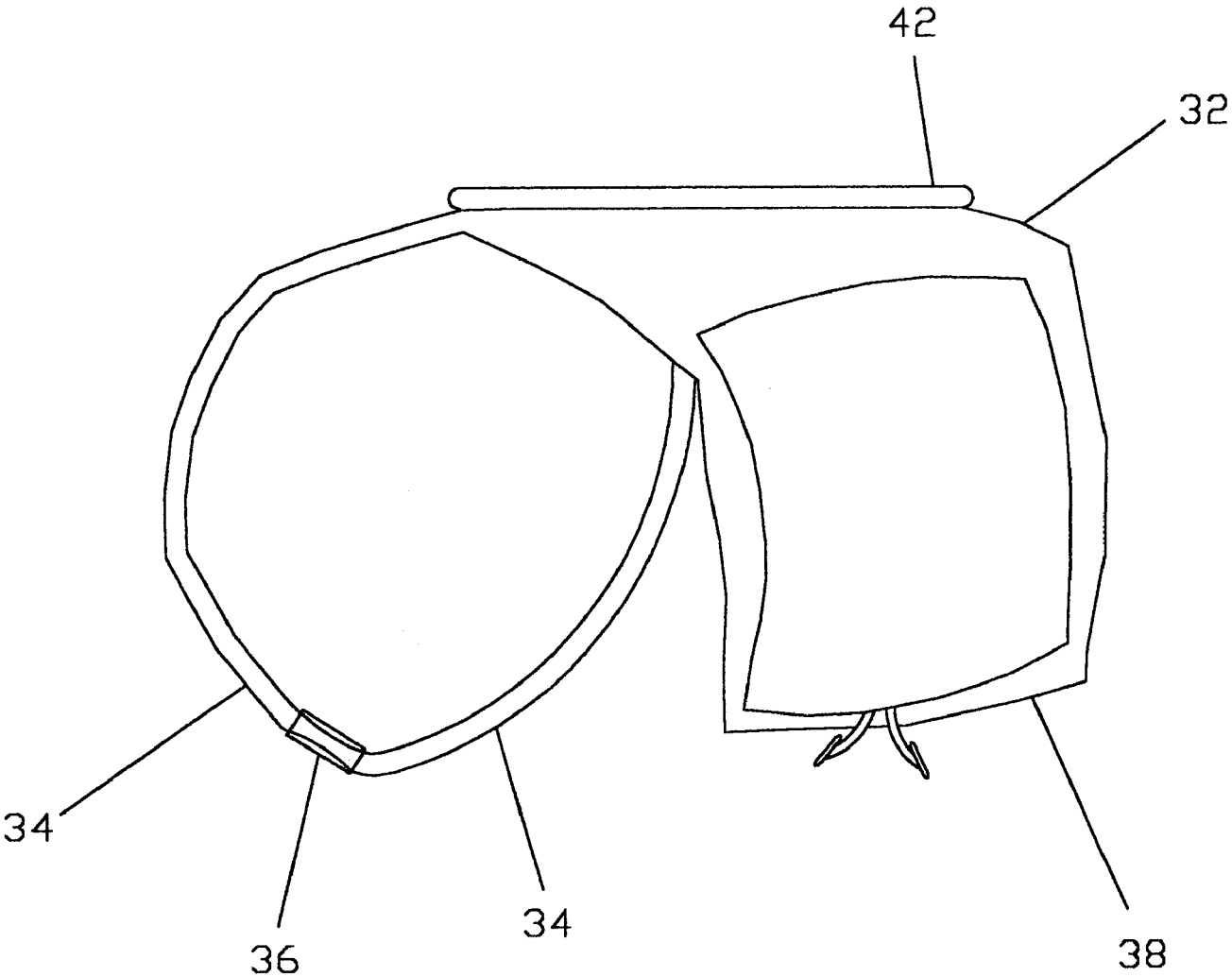
FIG. 5 is a side view of the harness with the backplate removed.

The device 30 is shown in use by a swimmer 20 in FIGS. 1–2 and the vest 32 is specifically depicted in FIGS. 4–5. In donning the device 30, the swimmer 20 places the vest 32 about his torso 21 by latching the shoulder straps 34 about his arms 22 using latch members 36, and by latching the vest torso belt 38 using latch members 40. The swimmer's legs 23 and feet 24 are not encompassed by the vest 32.

Figure 7:
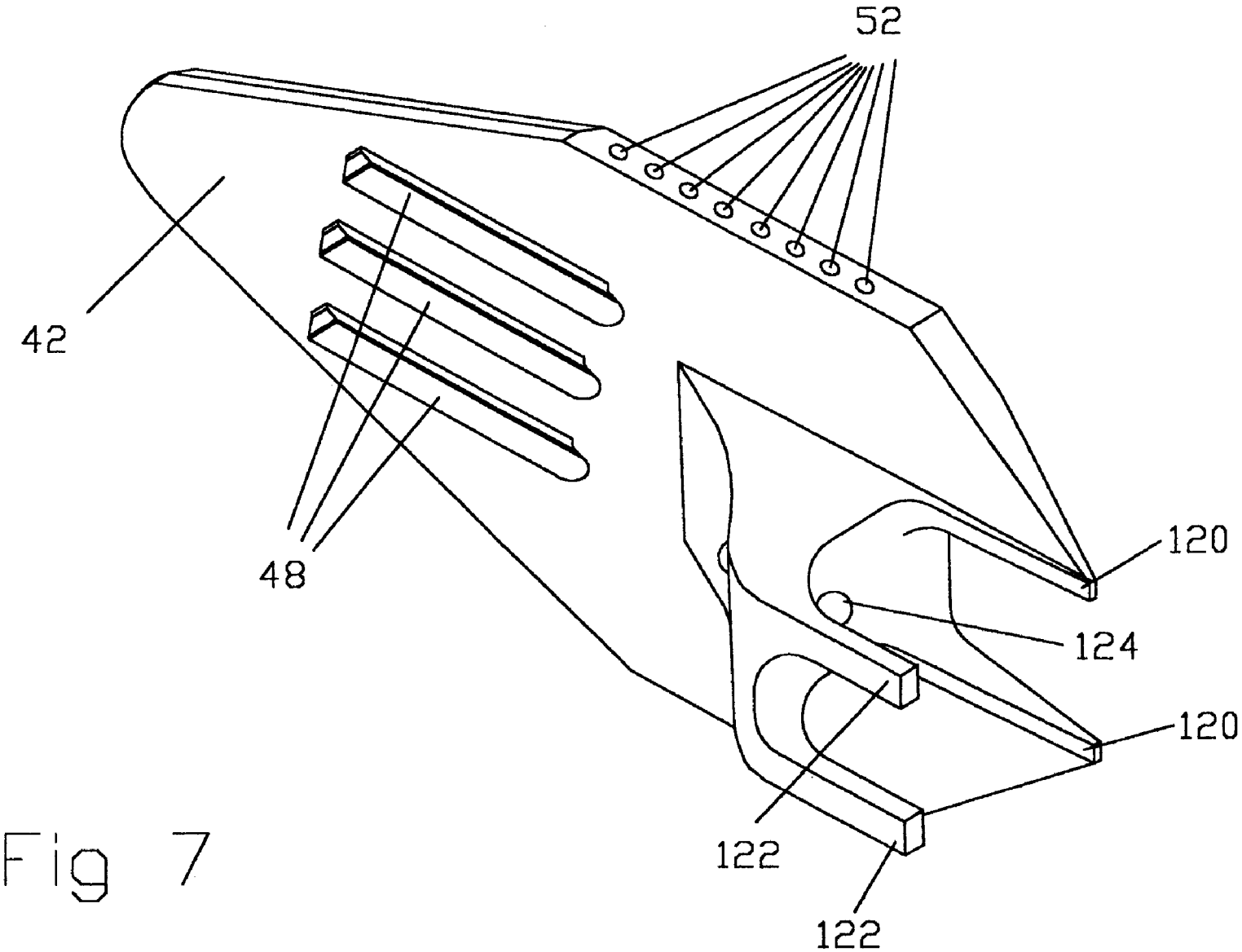
FIG. 7 is an oblique view of the backplate showing the portion that receives the forwardmost vertebra.
Figure 8:
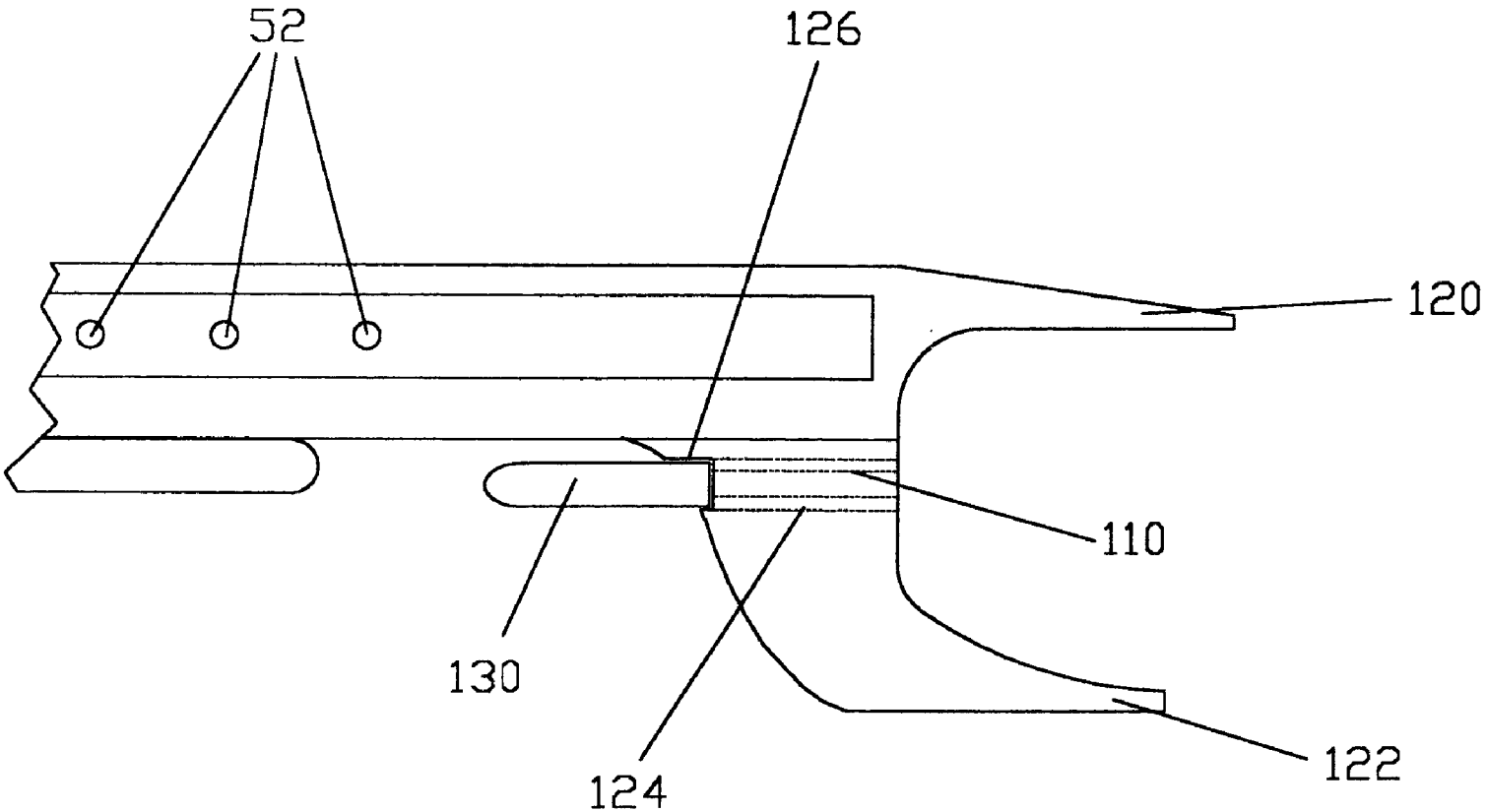
FIG. 8 is a side view of the backplate showing the cord path and cord hook.

When properly fitted to the swimmer 20, the vest 32 is positioned for receiving a backplate 42, the backplate 42 being shown specifically in FIGS. 7–8. The vest 32 positions a backplate attachment member 44, having three female runner slots 46, with the open end of the slots 46 pointed forwardly. Three male runners 48 on the backplate 42 are closely received by the runner slots 46 as the backplate 42 is brought rearward while directing the runners 48 into the runner slots 46. A detachable dorsal fin 50 extends from the backplate 42. It can be replaced with fins of varying shapes and sizes.

Figure 9:
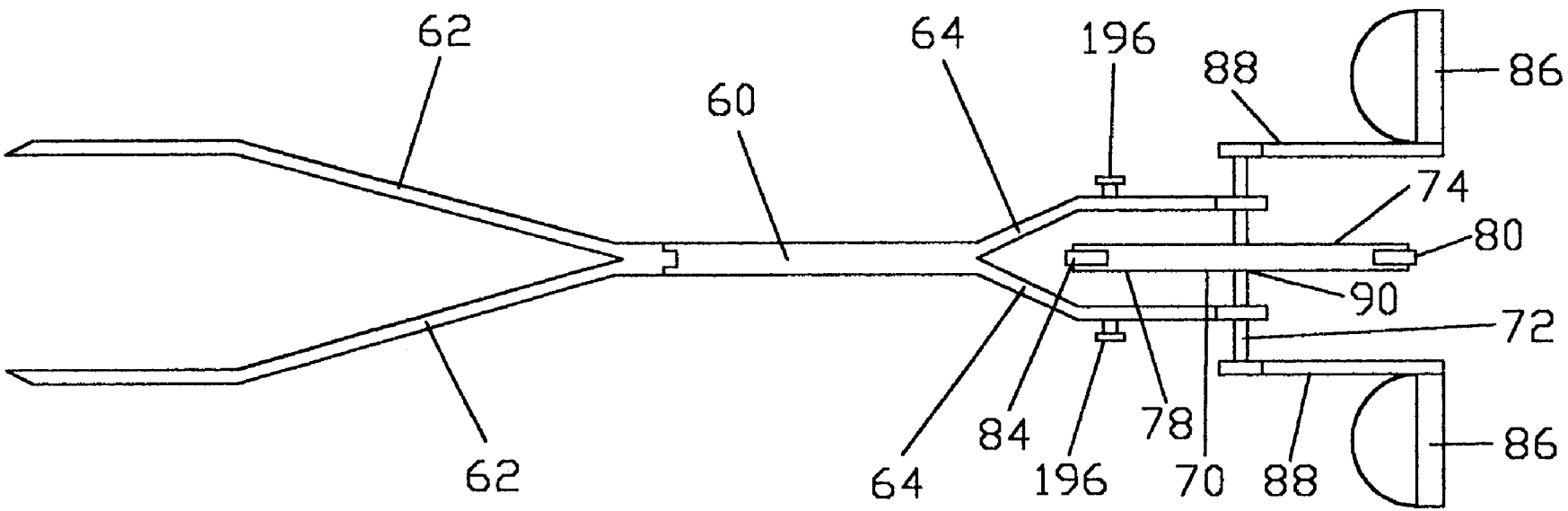
FIG. 9 is a top view of the frame and driver assembly.
Figure 10:
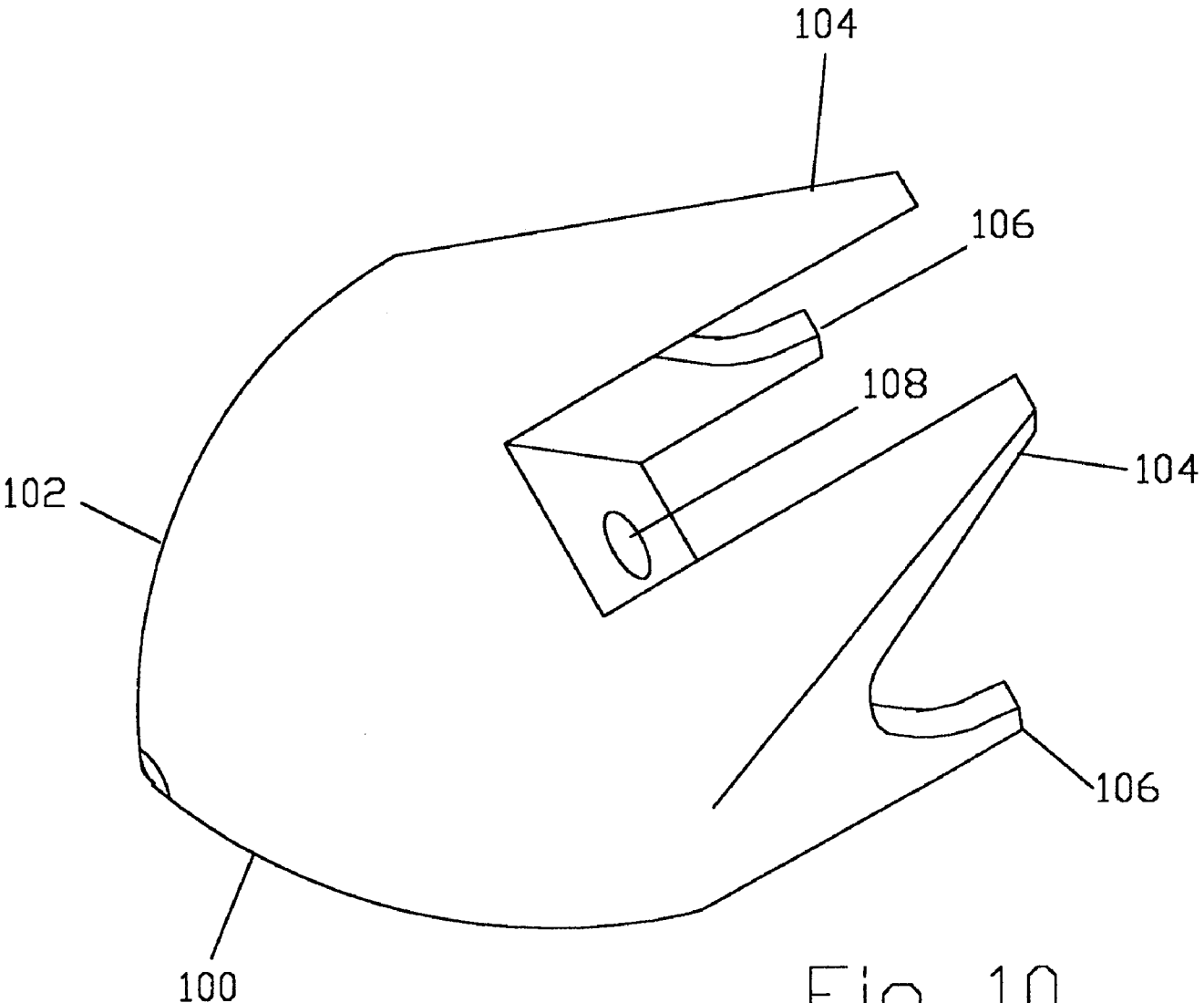
FIG. 10 is an oblique view of a vertebra.

Along both sides of the backplate 42 are holes 52 for receiving fasteners 54, the fasteners 54 attaching a frame 60, by fastening frame forward members 62 to the backplate 42, as shown in FIGS. 7–9. The backplate 42 can be constructed from typical rigid plastics or other materials.

As shown in FIG. 1 and FIG. 9, the frame forward members 62 extend rearwardly where they descend and join. As the frame 60 extends rearwardly it forks into frame rear member 64. Positioned on the frame rear members 64 for rotation is a driver 70 mounted on an axle 72. The driver 70 has a first, second and third apex member 74,76,78, each apex member 74,76,78 having a roller 80,82,84. Foot pedals 86, with conventional straps 87, are mounted on pedal arms 88, which are, in turn, attached to the axle 72. A ratchet gear 90 allows the pedal 86 to move free of the axle 72 when rotated in the clockwise direction, as viewed on FIG. 1. When the pedals 86 are rotated in the counter-clockwise direction (as viewed on FIG. 1) the driver 70 is rotated as well. Various rigid materials, including plastics and metals can be used for the frame 60, driver 70, pedals 86, axle 72, and pedal arms 88.

Figure 6:
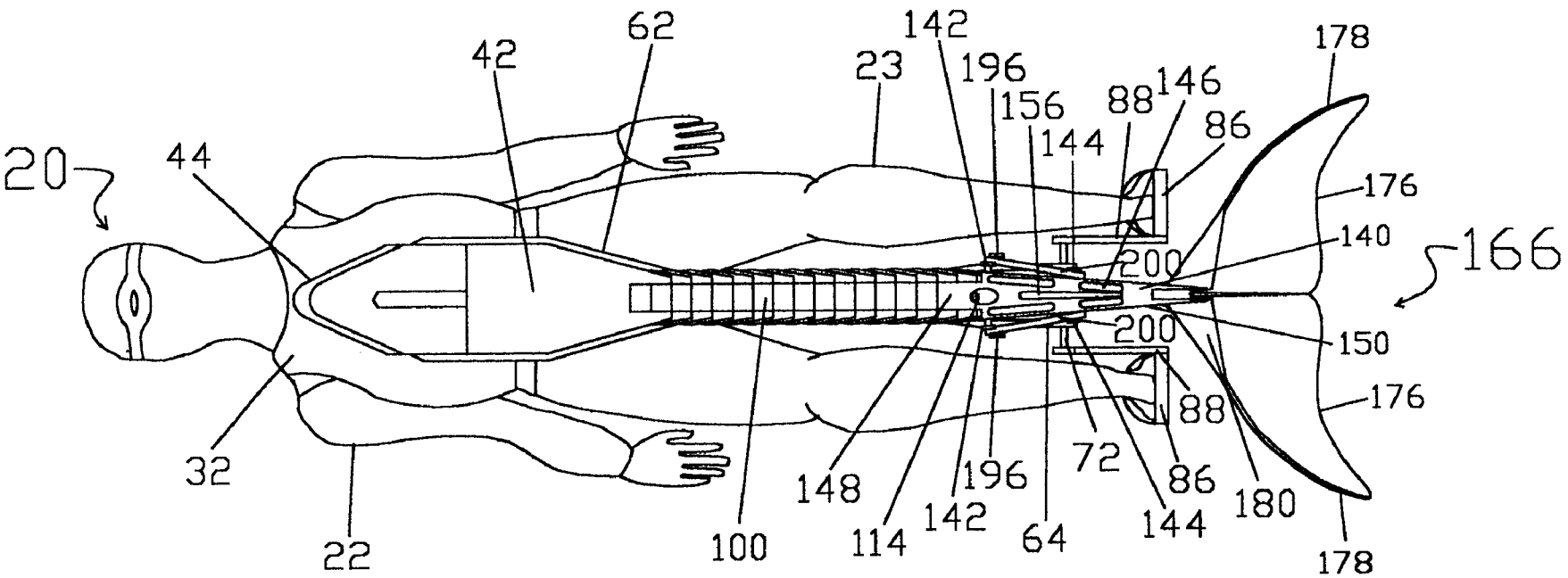
FIG. 6 is a top view of the device in use. The vertebrae shown have a substantially constant width.

An extended assembly of vertebrae 100 also extend from the backplate 42, as shown in FIGS. 1, 6, 10 and 11. Each vertebra 100 has a curved forward portion 102 that is partially encompassed by upper vertebrae extensions 104 and lower vertebrae extensions 106, when the forward portion 102 is inserted into the extensions 104,106 of another vertebrae 100. Each vertebrae 100 has a hole 108 through which a resilient cord 110 is run, the cord 110 extending along the length of the "spine." The cord 110 has a front loop 112 and a rear loop 114, as shown in FIG. 29. As shown in FIG. 6, the vertebrae 100 are substantially the same lateral width, but have a constantly decreasing vertical width, as shown in FIG. 1. The vertebrae 100 can be constructed from numerous resilient plastic materials.

The frontmost vertebra 100 is inserted among backplate upper extensions 120 and lower extensions 122 and is partially encompassed therein in a similar fashion as the other vertebrae 100. As shown in FIG. 8, the backplate 42 has a hole 124 and a slot 126 coincident with the hole 124, the hole 124 aligning with the vertebrae holes 108, allowing the cord 110 to extend into the backplate 42.

As the cord 110 passes through the backplate hole 124, a hook member 130 is used to secure the cord 110. The hook member 130 is shown separately in FIG. 12, and in place in FIG. 8. The hook member 130 has a hooked bar 132 and a loop 134. The bar 132 is inserted into the cord front loop 112, and as the cord 110 is pulled rearwardly through the vertebrae 100, the bar 132 is drawn into, and closely received by, the slot 124. This prevents the cord front loop 132 from being pulled back through the backplate hole 124.

Hook member loop 134 is provided for screwdriver insertion at a subsequent disassembly of the "spine."

Figure 13:
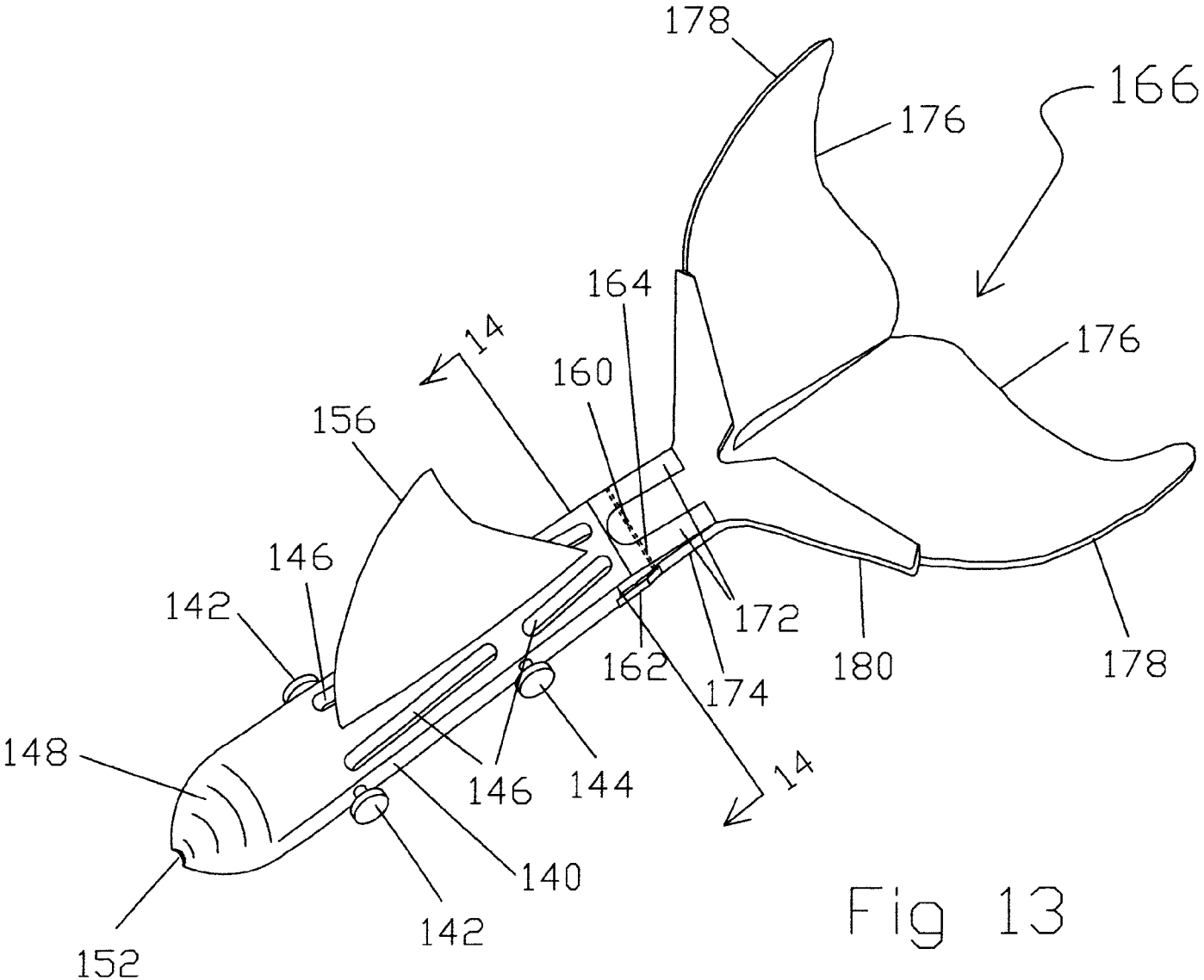
FIG. 13 is an oblique view of the thruster and fluke assembly.

Referring now to FIG. 13, wherein a thruster 140 is depicted. The thruster 140 has a pair of forward extensions 142 extending from the sides, a pair of rearward extensions 144 also extending from the sides, but at a more rearward point, and slots 146 extending through the thruster 140 from top to bottom. The thruster 140 also has a downwardly facing groove 147, as shown in FIG. 14.

The thruster 140 also has a dorsal fin 156 that is detachable and replaceable with fins of various sizes and shapes. The thruster 140 can be constructed from various resilient plastics, including fiberglass reinforced plastics.

The thruster 140 has a rounded front portion 148 that mates with, and is partially encompassed by the last vertebra 100 to the rear of the vertebrae 100 assembly. As shown in FIG. 14, the thruster 140 also has a rear portion 150. Extending through the thruster 140 is a hole 152 that aligns with the vertebrae holes 108 such that the cord rear loop 114 can be pulled through the thruster rear portion 150. The thruster hole 152 has a coincident slot 154. A bar 158 is inserted into the cord rear loop 114 and is drawn into, and closely received by the slot 154 to secure the cord 110. During assembly the cord rear loop 114 is so secured in the thruster rear portion slot 154, the cord 110 is routed through the vertebrae 100 and through the backplate hole 124, where the hook member 130 is inserted while the cord 110 is in tension.

Figure 14:
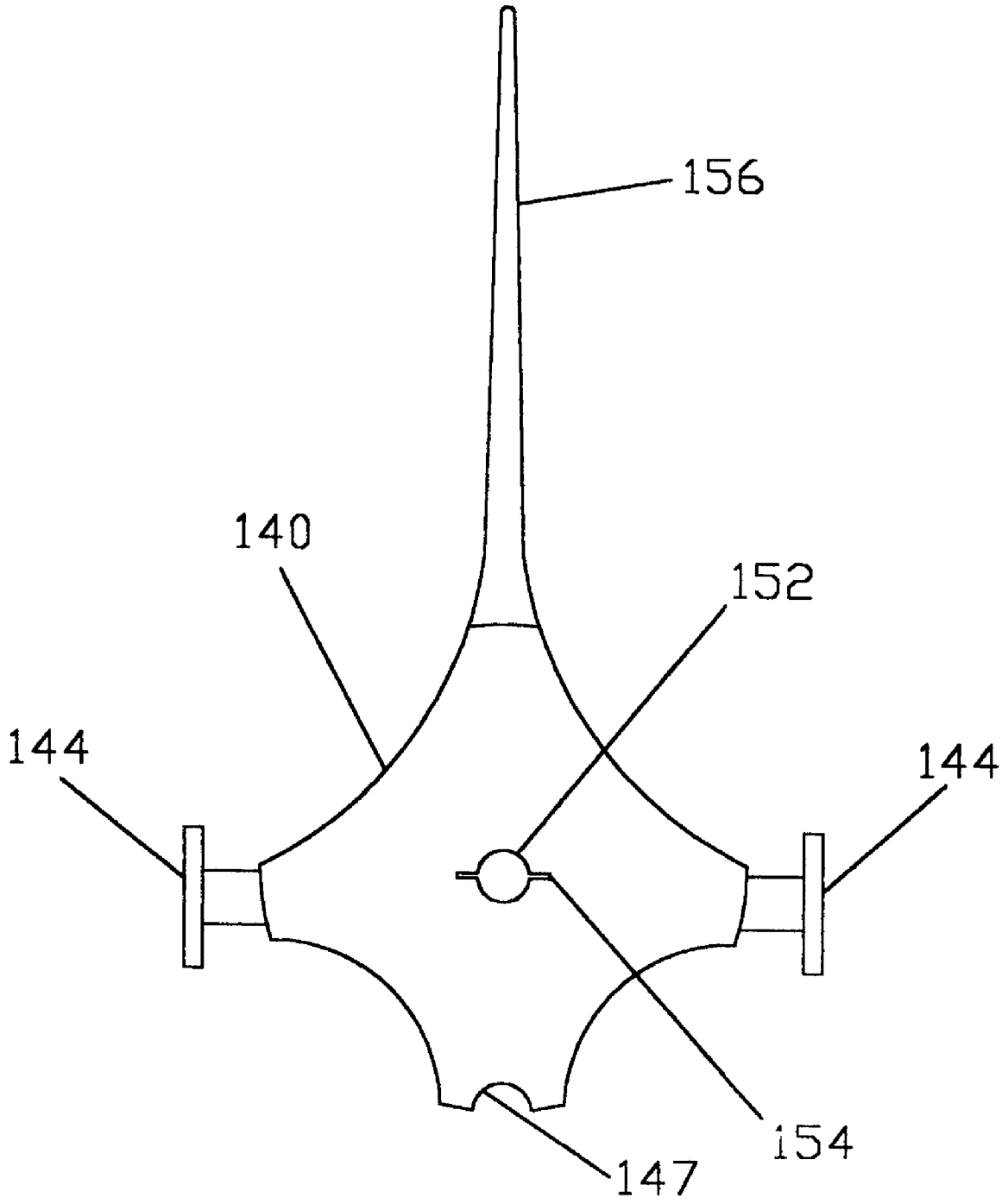
FIG. 14 is a sectional rear view along cutting plane 14—14 as shown on FIG. 13.
Figure 15:
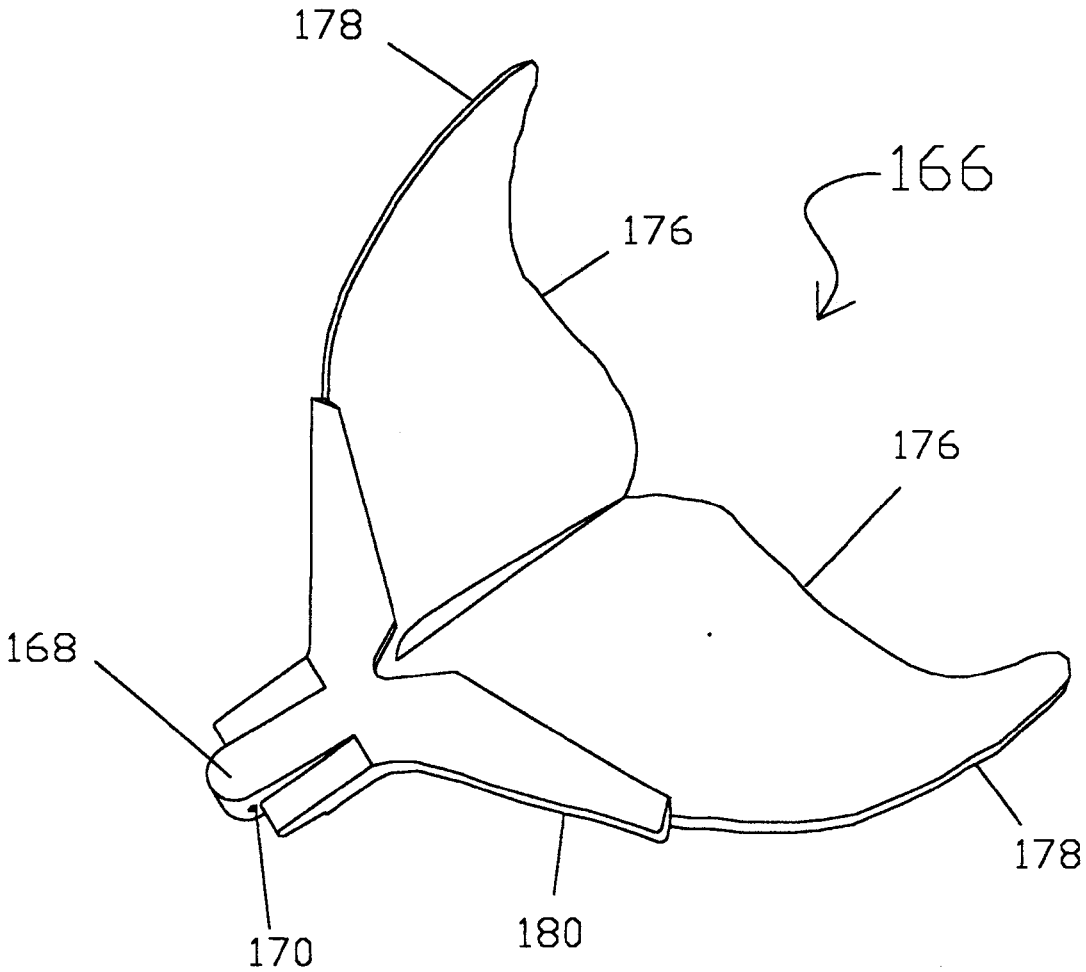
FIG. 15 is an oblique view of the fluke assembly.
Figure 16:
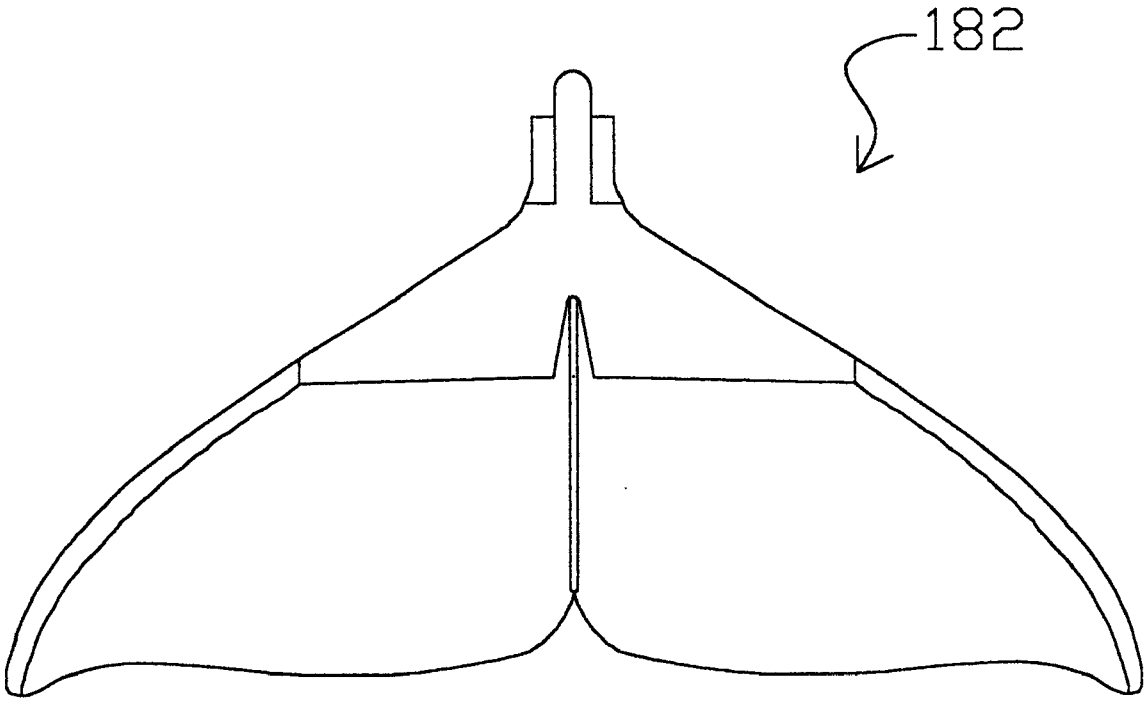
FIGS. 16–24 are top views of alternate fluke assemblies.
Figure 17:
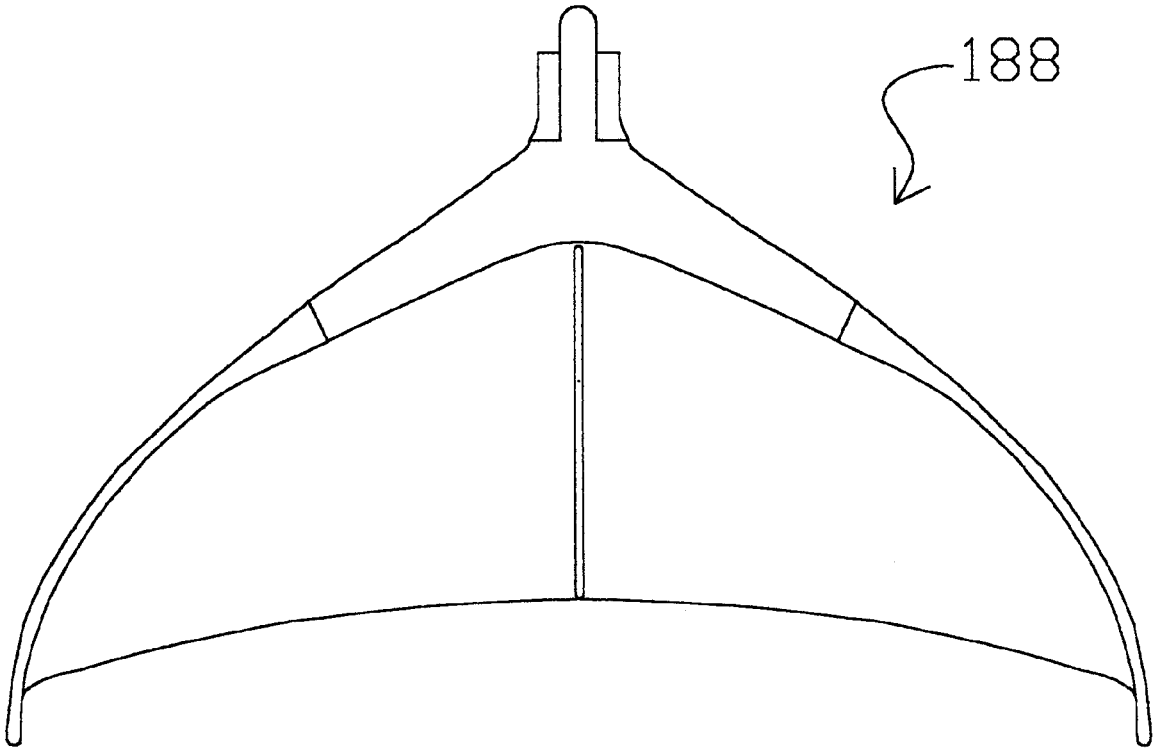
Figure 18:
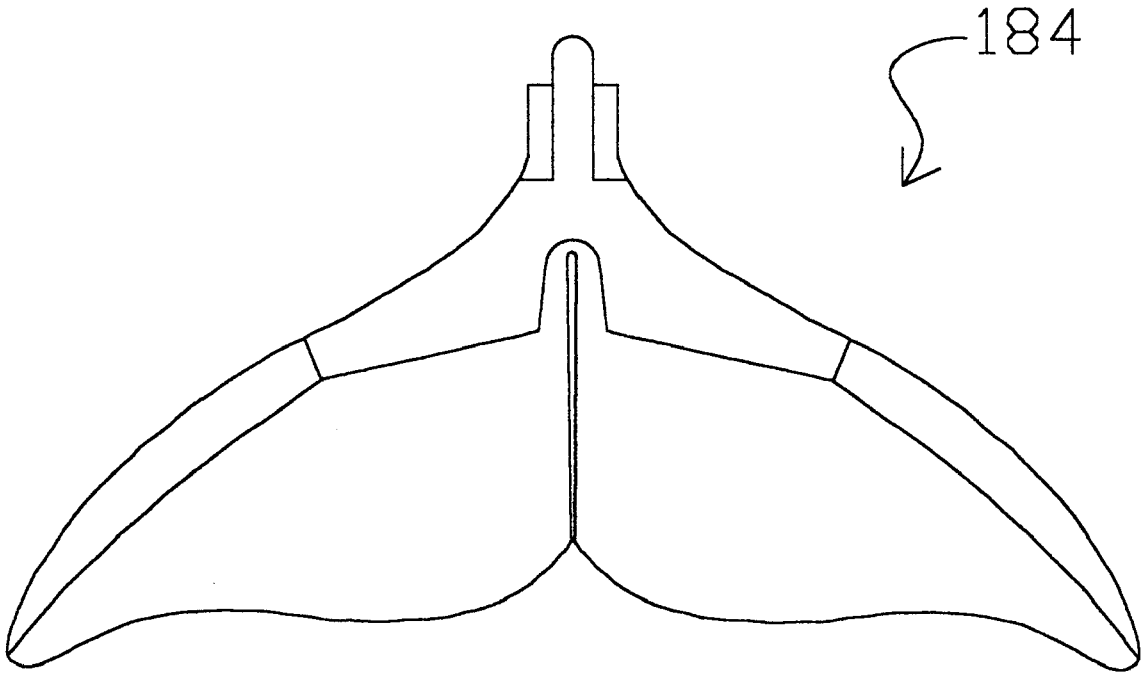
Figure 19:
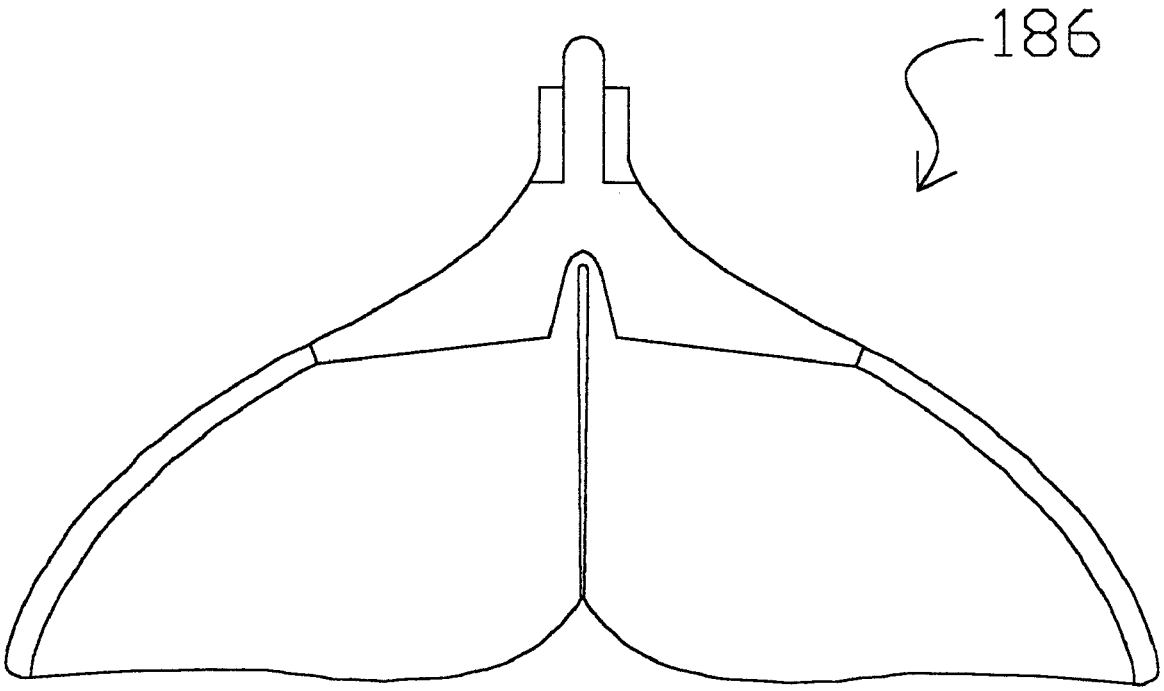
Figure 20:
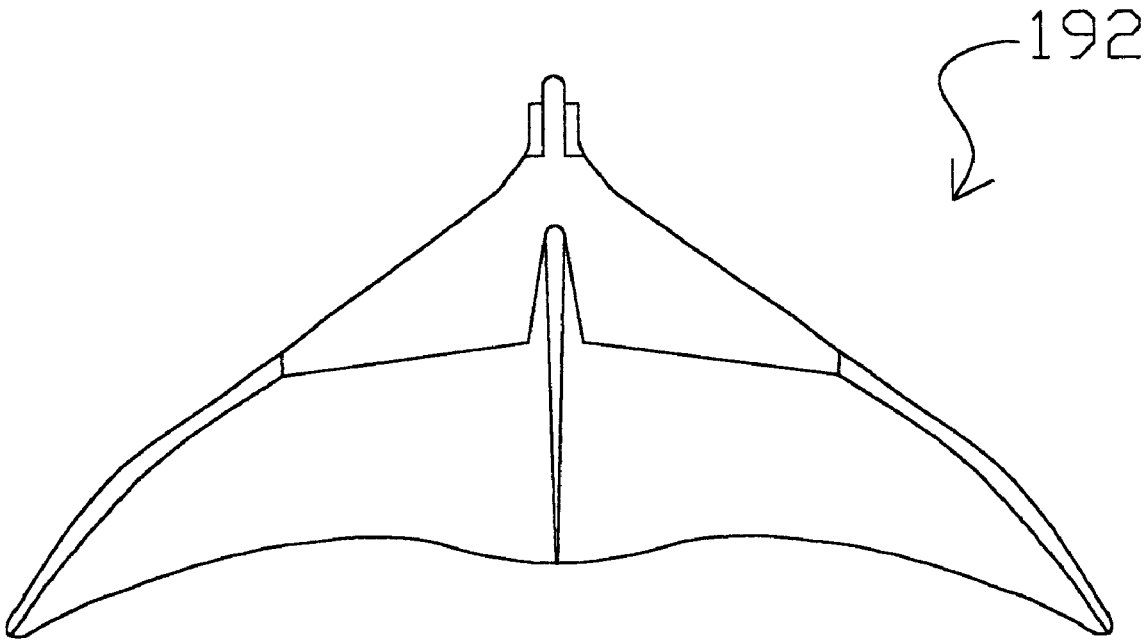
Figure 21:
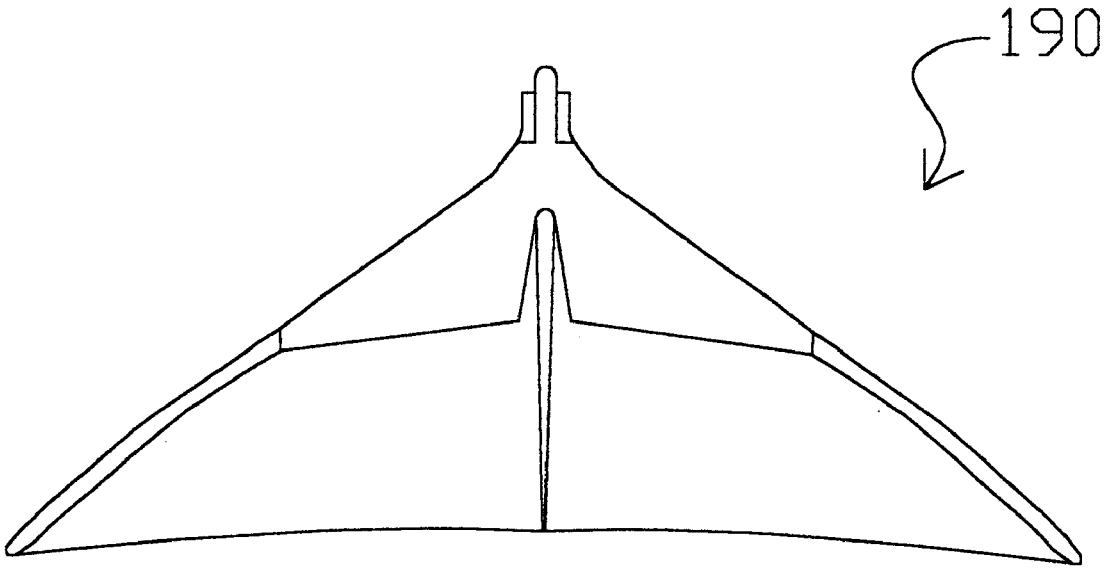
Figure 22:
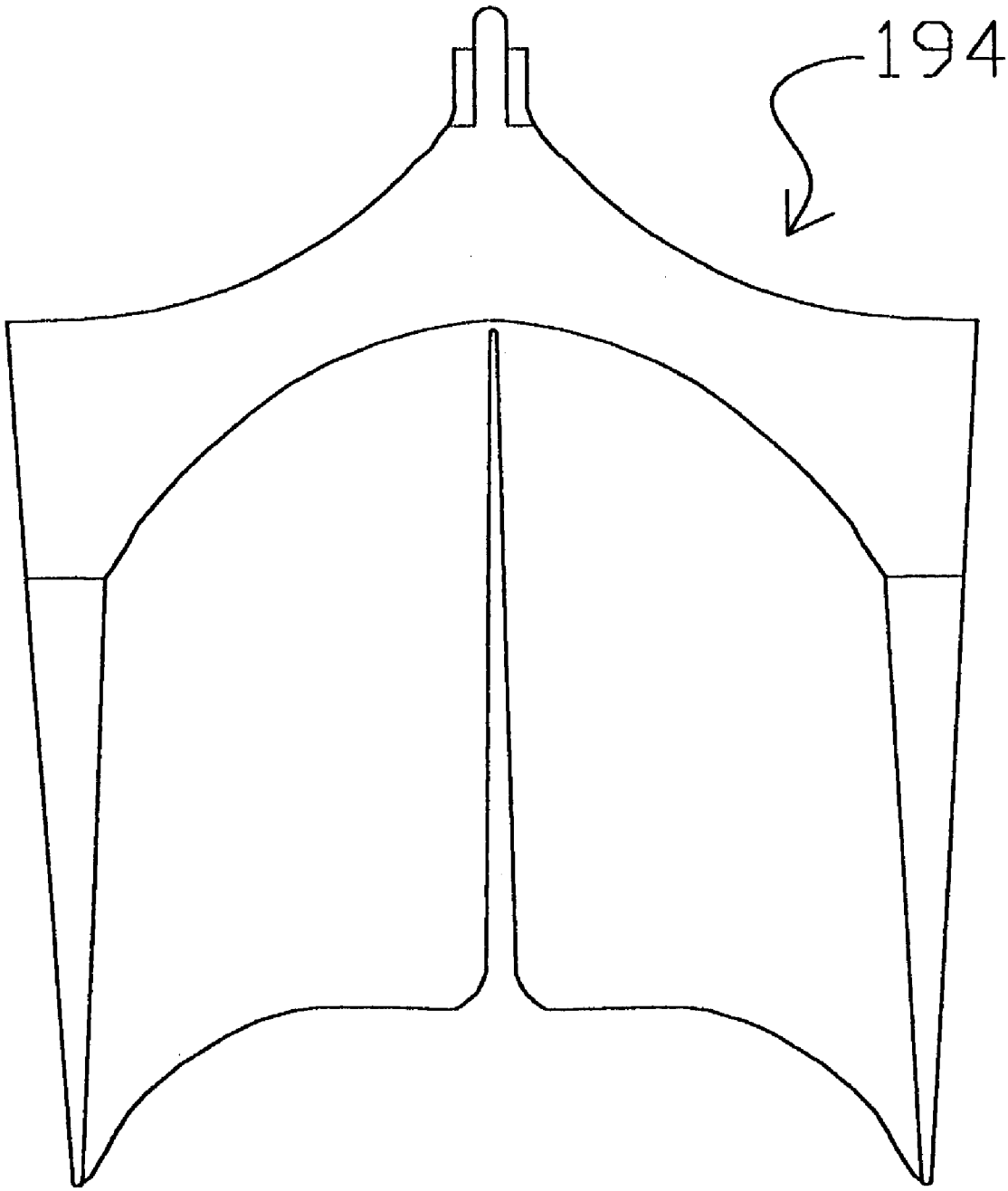
Figure 23:
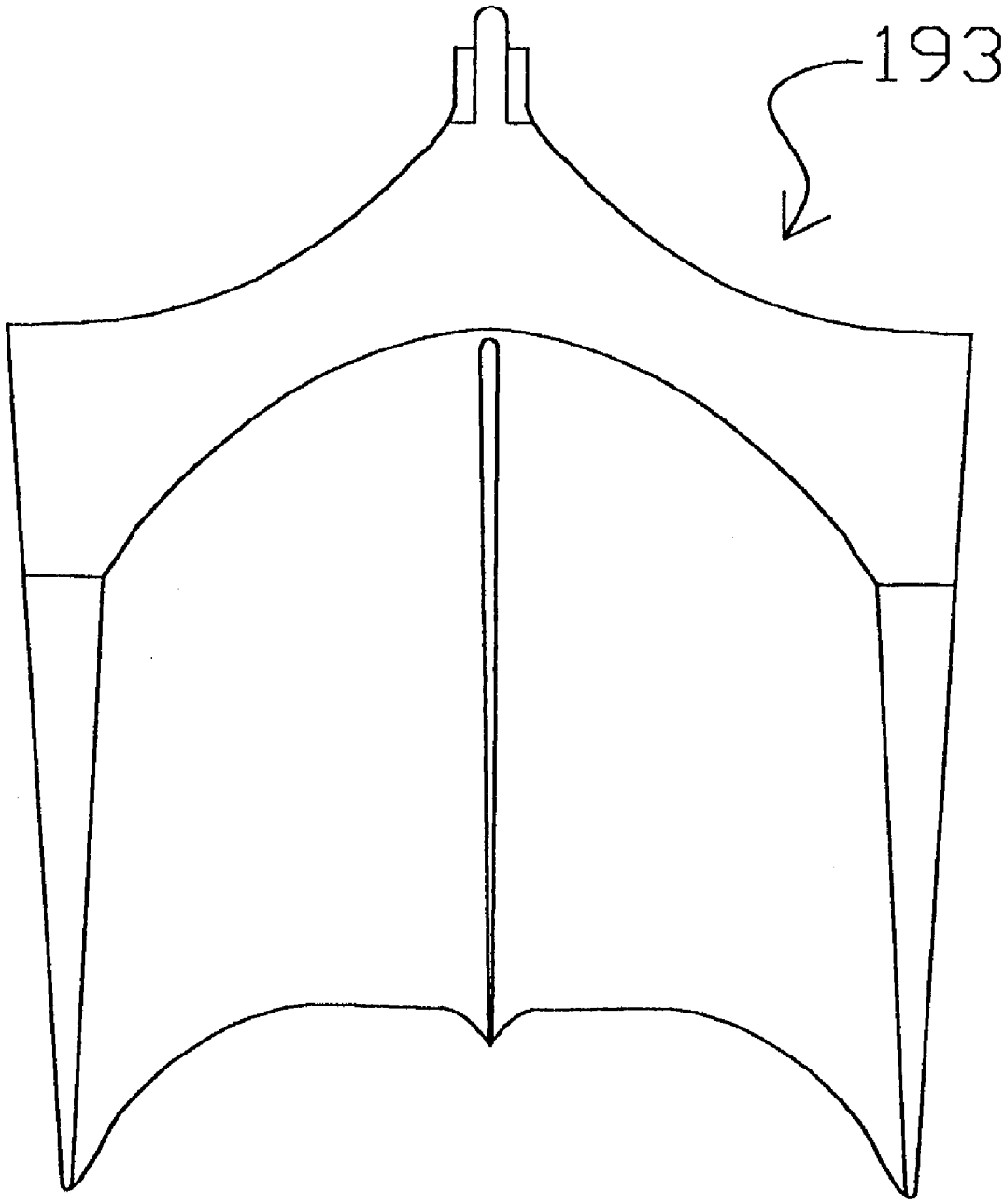
Figure 24:
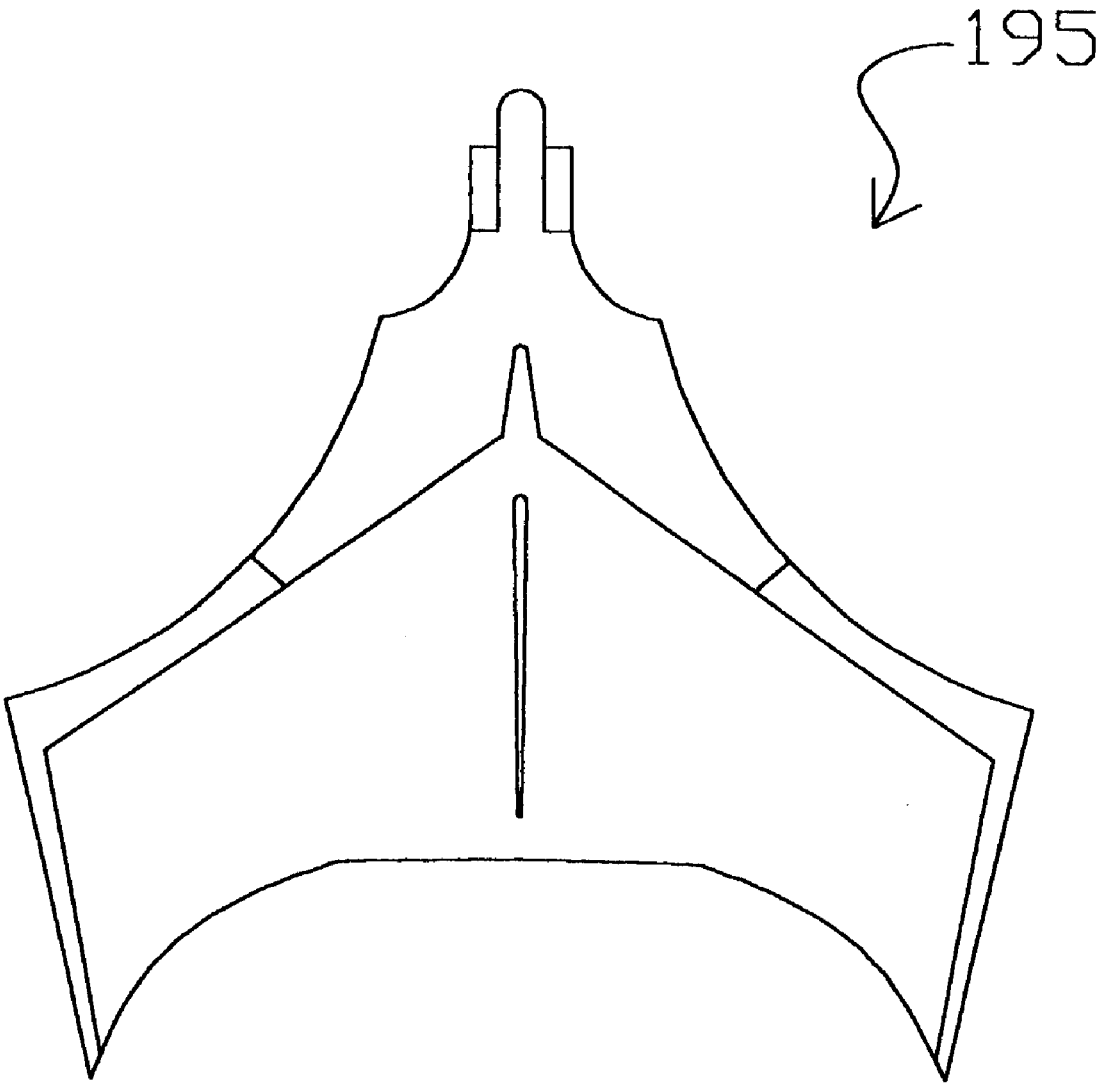

As shown in FIGS. 13–15, the thruster 140 has a pin 160, pin latches 162 and a pin hole 164 proximate the thruster rear portion 150. A fluke assembly 166 has a front portion 168 that is received by the thruster rear portion 150. The fluke front portion 168 has a pin hole 170 that aligns with the thruster rear portion pin hole 164, for insertion of the pin 160. The pin 160 is held in place by the pin latches 162.

The fluke front portion 168 is firmly mated with the thruster 140 by the restraining function of thruster rear upper extensions 172 and thruster rear lower extensions 174 that partially encompass the fluke front portion 168.

The fluke assembly 166 includes two flukes 176. The flukes 176 have thickened outer edges 178 that stiffen and laterally stabilize the flukes 176. The fluke assembly 166 also includes a central stabilizer 180 in the form of an upswept portion overlying part of the flukes 176. The central stabilizer 180 also stiffens and stabilizes the flukes 176, when the flukes 176 are moving downwardly. As shown in FIGS. 15–24, the flukes 176 can be shaped in accordance with the known flukes of dolphins 166, and orca whales 182, and in other designer shaped flukes 184,186,188,190,192, 193,194,195,196. The fluke assembly 166 can be constructed from various plastics, including fiberglass reinforced-plastics. As shown further in FIG. 26, the fluke assembly portion of the tail member further comprises a tail member top and a substantially rigid member 181 positioned proximate the tail member top, such that as the tail member is forced back to the first position, the tail member top is forced against the rigid member, the rigid member then at least partially impeding the further deformation of the fluke assembly portion of the tail member.

As shown in FIGS. 1–2, the frame 60 has a pair of extensions 196. A pair of resilient propulsion bands 200 connect the thruster rearward extensions 144 and the frame extensions 196. FIG. 1 depicts the swimmer's knees in a bent position 23 after the swimmer 20 has ratcheted the foot pedals 86 forward. Prior to pushing rearwardly on the pedals 86, the third apex member roller 84 and the first apex member roller 80 are both adjacent the thruster 140, the roller 80 being laterally constrained within the thruster groove 147. As the swimmer 20 pushes on the pedals 86, the pedal arms 88 engage the driver 70 through ratchet gear 90. As the driver 70 is forced into counter-clockwise rotation, first apex member roller 80 is forced against the thruster 140, moving the thruster 140 upwardly, while simultaneously creating tension in the propulsion bands 200 as they are stretched. FIG. 2 depicts the stretched propulsion band 200 and the third apex member roller 80 at the point of maximum thruster 140 displacement, that is when the third apex member is perpendicular to the thruster 140. At this point the flukes 176 have been raised and the propulsion bands 200 have been significantly tensioned. Also, the vertebrae 100 assembly has been bent causing an elastic deformation within the individual vertebra 100.

By following through with the rearward push, the pedal arms 88 force the driver 70 beyond the point shown in FIG. 2, and the tension in the propulsion bands 200 and the elastic deformation of the vertebrae 100 is released. When released from tension and deformation both the propulsion bands 200 and the vertebrae 100 force the flukes 176 sharply downward, thus thrusting the swimmer 20 forward.

After this release the first apex member roller 80 and the second apex member roller 82 are then adjacent the thruster 140. For the next thrusting event, the swimmer 20 again ratchets the foot pedals 86 forward and then pushes rearwardly. In this event, the second apex member roller 82 will be forced against the thruster 140, and laterally constrained within the thruster groove 147, with analogous stretching of the propulsion bands 200 and deformation of the vertebrae 100.

The thruster 140 is also resilient and deforms as it is borne upon by the apex member rollers 80,82,84. As it returns to the undeformed shape it adds additional thrust to that provided by the propulsion bands 200 and vertebrae 100.

The present invention also encompasses various combinations of propulsion bands 200 (of varying length and tensions) and thruster rearward and forward extensions 142 and 144 (placed at varying positions along the thruster 140). Such combinations allow alternate propulsion ban 200 configurations on the available extensions 142,144, and variations in the amount of thrust and the force necessary to push the pedals 86 to vary.

Figure 27:
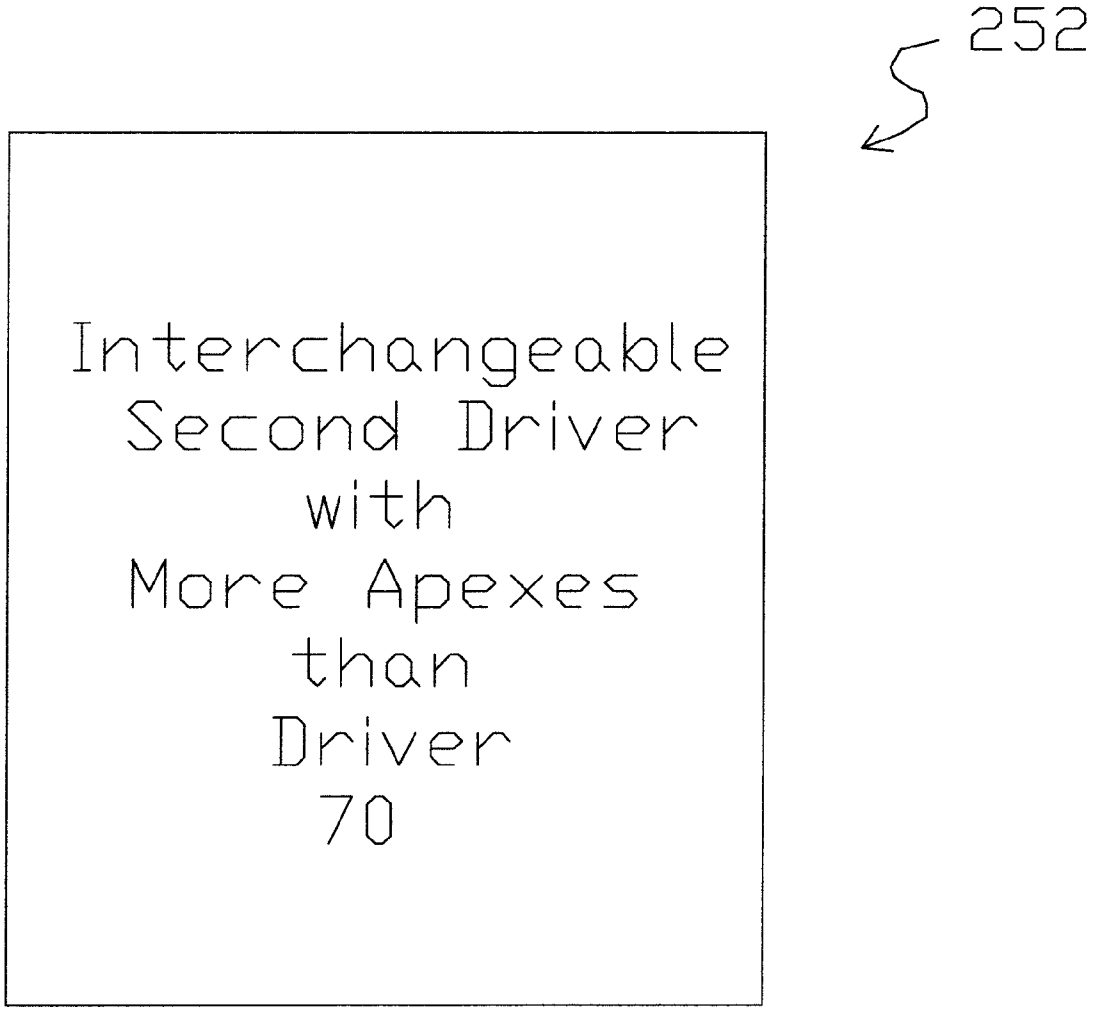
FIG. 27 is a rectangular box indicating an interchangeable alternate driver.
Figure 28:
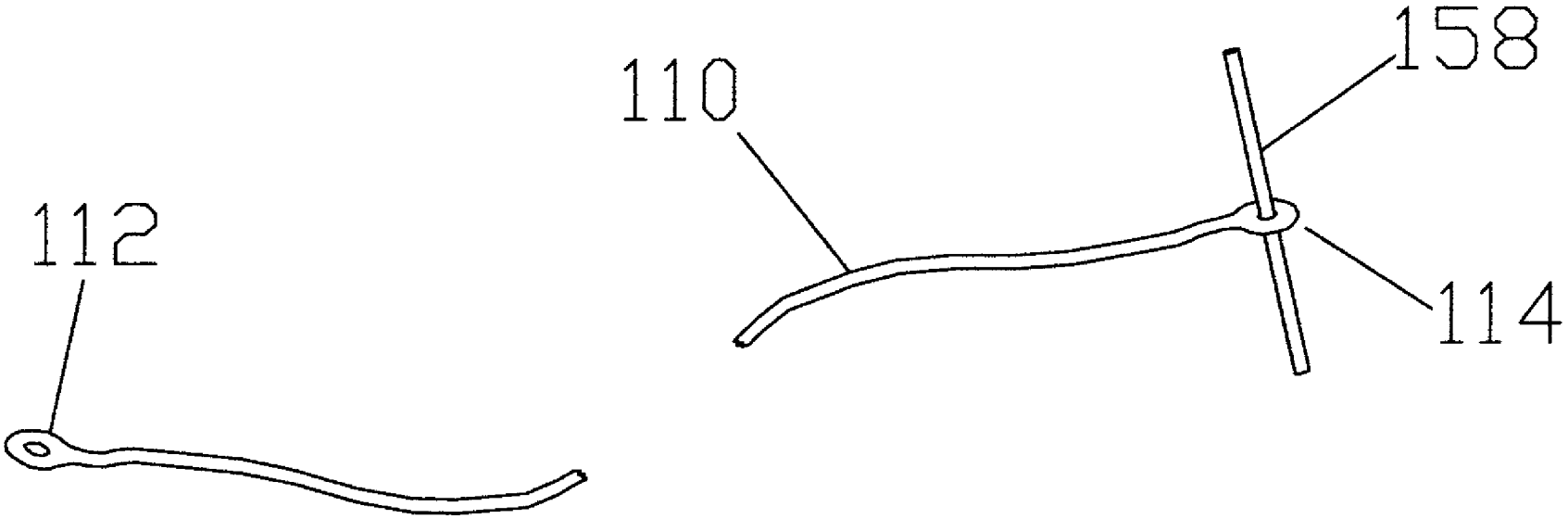
FIG. 28 is a perspective view of the cord.

Similarly, the present invention also encompasses drivers with varying numbers of apexes, and with apexes of various heights. This will allow a varying thruster vertical response, thus varying the amount of thrust. It will also allow varying force requirements for pushing the pedals 86. For example FIG. 27 depicts an alternate embodiment of a driver with more apexes than driver 70.

The present invention also encompasses a single pedal embodiment, where the current pedals are replaced by a single member that moves both pedal arms.

In FIG. 1, pedal 86 also depicts the single pedal embodiment. Similarly, the number of pedal arms and propulsion bands can be reduced to one. In another embodiment, each pedal arm can ratchet independently of the other, while each rotates the driver during its rearward push.

In another embodiment, the rollers 80,82,84 are eliminated.

In another embodiment, fluke outer edges are reinforced with stiffeners, such as fiberglass, or metal rods.

In another embodiment, the flukes are substantially rigid.

Figure 25:
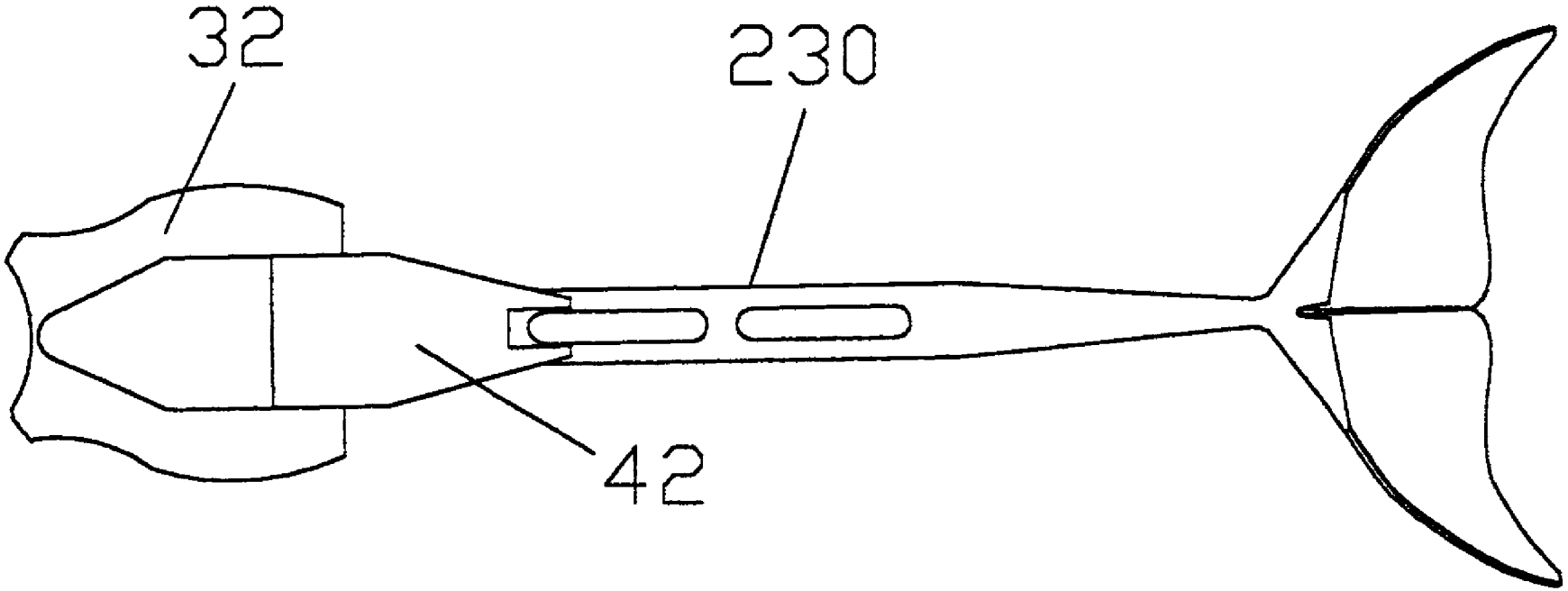
FIG. 25 is a top view of an alternate tail assembly.
Figure 26:
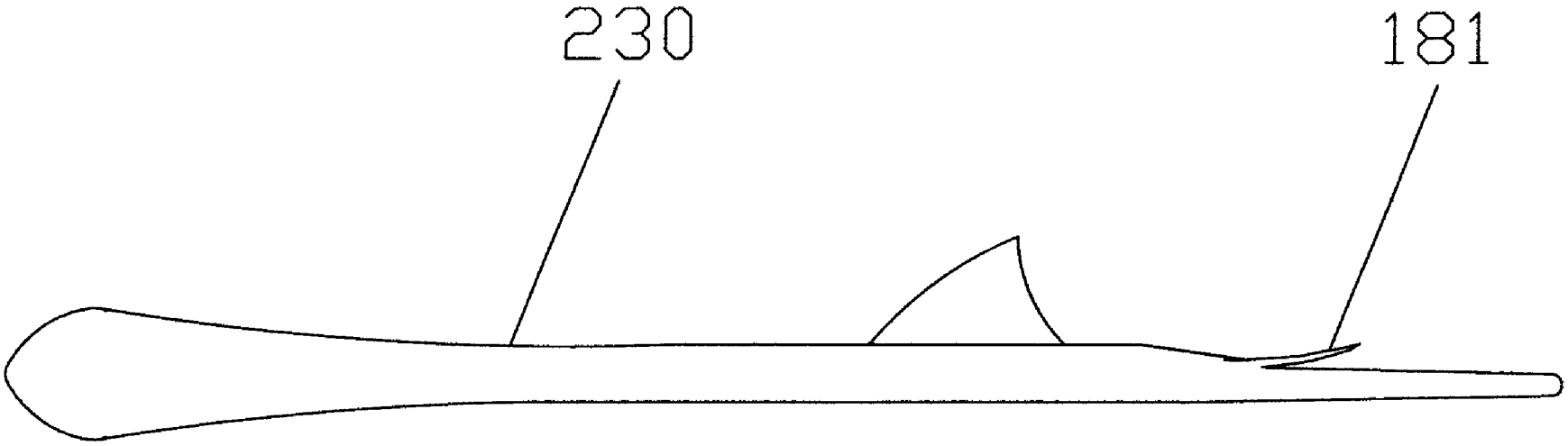
FIG. 26 is a side view of the alternate tail assembly portion of FIG. 25.

In another embodiment, the backplate, vertebrae, thruster, and fluke assembly are replaced by a single, resilient member 230. This embodiment is shown in FIGS. 25–26.

Figure 11:
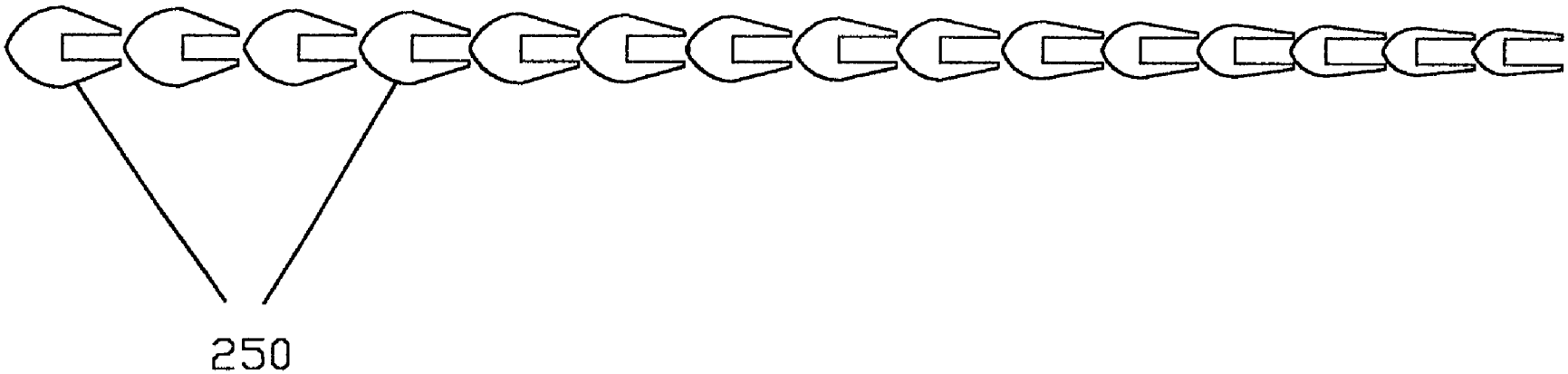
FIG. 11 is an exploded top view of alternate vertebrae that have decreasing width.
Figure 12:
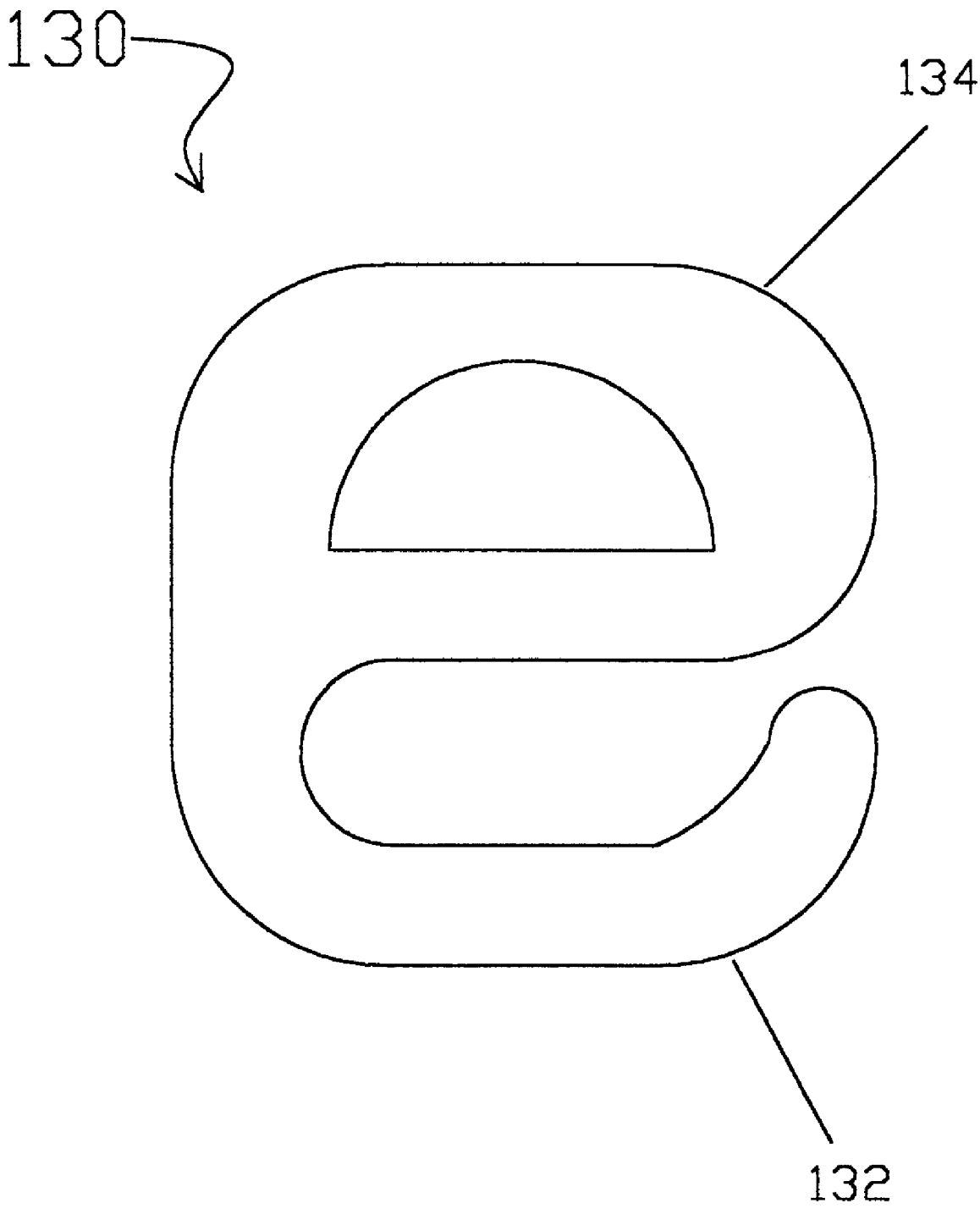
FIG. 12 is a top view of the cord hook.

In another embodiment, shown in FIG. 11, the vertebrae 250 have constantly decreasing lateral widths.

Although particular types of materials and particular dimensions have been discussed herein, other types and sizes of materials can also be used, all in accordance with the present invention, and as determined by the intended end use for the overall device, as will occur to those of skill in the art upon review of the present disclosure. In particular, further flukes and/or other tail members of various sizes and shapes, and various cooperations with different spines may be envisioned with in the scope of the present invention. Accordingly, the preceding description and figures are illustrative only and are not to be considered as limitations on the scope of the present invention.

Without further analysis, the foregoing will so fully reveal the gist of the present invention that others can, by applying current knowledge, readily adapt it for various swimming applications without omitting features that, from the standpoint of prior art, fairly constitute essential characteristics of the generic or specific aspects of this invention.

I claim:

1. A swimmer propulsion device, comprising:

a harness to be affixed to the body of the swimmer;

a frame extending from the harness toward the feet of the swimmer;

a tail assembly having:

a flexible spine; and a tail member;

a foot-powered driving assembly having:

at least one foot pedal to be attached to the swimmer's foot, the at least one foot pedal having a forward position and a rearward position; and a driver rotatably attached to the frame and ratchetably rotated by a rearward push on the at least one foot pedal, the driver having at least three apex members, the driver being spaced from the tail assembly such that two of the apex members are proximate the tail assembly; and at least one resilient propulsion member attached to the tail assembly and the frame, such that, as the at least one foot pedal is being pushed rearwardly, the driver is rotated causing one of the apex members to singularly bear upon the tail assembly, the single apex member displacing the tail assembly such that the tail member moves from a first position to a second position, the displacement of the tail assembly placing the at least one propulsion member in tension, the continued rotation of the driver causing the single apex member to rotate beyond a perpendicular position against the tail assembly, the propulsion member tension then causing the at least one propulsion member to contract and pull the tail assembly such that the tail member is brought from the second position to the first position, the at least one foot pedal being ratchetably movable to the forward position.

2. The device of claim 1, wherein each apex member has a roller, the roller being the portion of the apex member that bears upon the tail assembly.

3. The device of claim 1, wherein the tail assembly has a generally longitudinal groove, the groove receiving and laterally constraining the single apex member as the single apex member bears upon the tail assembly.

4. The device of claim 1, wherein the number of pedals is two and the number of propulsion members is two, the pedals being attached for simultaneous movement from the forward to the rearward position.

5. The device of claim 1, wherein the number of pedals is two, each pedal being independently ratchetable and pushable, such that the driver is rotated by pushing either of the pedals.

6. The device of claim 1, wherein the number of pedals is one, the pedal being adapted for simultaneous pushing by both swimmer feet.

7. The device of claim 1, wherein the spine further comprises a first vertebra and a plurality of vertebrae, each of the vertebrae plurality being successively and partially encompassed by another of the vertebrae, and a resilient cord extending through the vertebrae such that the vertebrae are aligned and secured, the vertebrae being resilient such that, as the tail assembly is displaced by the single apex member, the vertebrae are deformed, and as the single apex member rotates beyond the perpendicular position against the tail assembly, the vertebrae return to the undeformed state, thus causing a displacement of the tail assembly such that the tail member is moved toward the second position.

8. The device of claim 7, wherein the vertebrae having decreasing widths in a direction horizontally perpendicular to the longitudinal axis of the tail assembly.

9. The device of claim 7, wherein the vertebrae having decreasing heights in a direction vertically perpendicular to the longitudinal axis of the tail assembly.

10. The device of claim 1, wherein the harness has at least one dorsal fin.

11. The device of claim 10, wherein the at least one dorsal fin is detachable.

12. The device of claim 1, wherein the tail assembly has at least one dorsal fin.

13. The device of claim 12, wherein the at least one dorsal fin is detachable.

14. The device of claim 1, wherein the tail member has at least one dorsal fin.

15. The device of claim 14, wherein the at least one dorsal fin is detachable.

16. The device of claim 1, wherein the tail member is flexible.

17. The device of claim 1, wherein the tail member has two flukes.

18. The device of claim 17, wherein the tail member flukes have at least one thickened edge.

19. The device of claim 17, wherein the tail member flukes have at least one reinforced edge.

20. The device of claim 1, wherein the harness further comprises a first back member and a second back member, the second back member being coupled to the first back member, the frame being attached to the harness second back member.

21. The device of claim 20, wherein the second back member is slidably coupled to the first back member.

22. The device of claim 1, wherein the harness further comprises a first back member and a second back member, the second back member being coupled to the first back member, the tail assembly being attached to the harness second back member.

23. The device of claim 22, wherein the second back member is slidably coupled to the first back member.

24. The device of claim 1, wherein the tail member further comprises lateral stabilizers.

25. The device of claim 1, wherein the tail member further comprises at least one thickened outer edge.

26. The device of claim 1, wherein the tail member further comprises at least one reinforced outer edge.

27. The device of claim 1, wherein the device further comprises a second driver to be interchanged with the driver, the second driver having longer apexes than the driver.

28. The device of claim 1, wherein the device further comprises a second driver to be interchanged with the driver, the second driver having shorter apexes than the driver.

29. The device of claim 1, wherein the device further comprises a second driver, interchangeable with the driver, the second driver having more apexes than the driver.

30. The device of claim 1, wherein the device further comprises a second driver, interchangeable with the driver, the second driver having less apexes than the driver, but at least three apexes, and further wherein the driver has more than three apexes and the second driver has three apexes.

31. The device of claim 1, wherein the tail assembly further comprises a resilient portion, the driver single apex bearing upon such resilient portion during rotation such that the portion is deformed as the single apex member rotates, and returns to the undeformed state when the single apex member rotates beyond the perpendicular position against the portion, thus causing a displacement of the tail assembly such that the tail member is moved toward the second position.

32. The device of claim 31, wherein the resilient portion has a generally longitudinal groove, the groove receiving and laterally constraining the single apex member as the single apex member bears upon the resilient portion.

33. The device of claim 1, wherein the device further comprises a second propulsion member, interchangeable with the at least one propulsion member, the second propulsion member requiring a different amount of force for tensioning.

34. The device of claim 1, wherein the tail member further comprises a central stabilizer.

35. The device of claim 1, wherein the tail member further comprises a tail member top and a substantially rigid member positioned proximate the tail member top, such that as the tail member is forced back to the first position, the tail member top is forced against the rigid member, the rigid member then at least partially impeding the further deformation of the tail member.

36. The device of claim 1, wherein the tail member is removably attached.

37. The device of claim 36, wherein the device further comprises a second tail member, interchangeable with the tail member.

38. A swimmer propulsion device, comprising:

a harness to be affixed to the body of the swimmer;

a frame extending from the harness toward the feet of the swimmer;

a tail assembly having:
a flexible spine; and
a tail member;

means for moving the tail member from a first position to a second position using footpower; and means for forcing the tail member from the second position to the first position.

39. The device of claim 38, wherein the tail member further comprises means for lateral stabilization.

40. The device of claim 38, wherein the tail member further comprises means for central stabilization.

41. The device of claim 38, wherein the means for forcing the tail member from the second position to the first position further comprises means for varying the rate at which the tail member is forced back to the first position.

42. The device of claim 38, wherein the means for moving the tail member from the first position to the second position further comprises means for varying the distance between said positions.

43. A swimmer propulsion device, comprising:

a harness to be affixed to the body of the swimmer, the harness further comprising a first back member and a second back member, the second back member being slidably coupled to the first back member;

a frame extending from the harness second back member toward the feet of the swimmer;

a tail assembly extending from the harness second back member having:
a flexible spine, the spine further comprising a first vertebra and a plurality of vertebrae, each of the vertebrae plurality being successively and partially encompassed by another of the vertebrae, and a resilient cord extending through the vertebrae such that the vertebrae are aligned and secured;
a resilient portion, having a generally longitudinal groove; and
a tail member;

a foot-powered driving assembly having:
a pair of foot pedals to be attached to the swimmer's feet, the pedals having a forward position and a rearward position; and
a driver rotatably attached to the frame and ratchetably rotated by a rearward push on the foot pedals, the driver having three apex members, each apex member having a roller, the driver being spaced from the tail assembly such that two of the apex member rollers are proximate the tail assembly resilient portion longitudinal groove; and a pair of resilient propulsion members attached to the tail assembly and the frame, such that, as the foot pedals are being pushed rearwardly, the driver is rotated causing one of the apex member rollers to singularly bear upon the resilient portion longitudinal groove, the single apex member roller displacing the tail assembly such that the tail member moves from a first position to a second position, the displacement of the tail assembly placing the propulsion members in tension, the continued rotation of the driver causing the single apex member roller to rotate beyond a perpendicular position against the tail assembly, the propulsion member tension then causing the propulsion members to contract and pull the tail assembly such that the tail member is brought from the second position to the first position, the foot pedals being ratchetably movable to the forward position.

* * * * *